US011486199B2

(12) United States Patent
Mora et al.

(10) Patent No.: US 11,486,199 B2
(45) **Date of Patent: *Nov. 1, 2022**

(54) LADDER, END CAP AND METHOD

(71) Applicants: Daniel C. Mora, Transfer, PA (US); Robert Beggs, Stoneboro, PA (US); Brent Sedlacek, Elmurst, IL (US); James Anthony Jacobs, New Castle, PA (US)

(72) Inventors: Daniel C. Mora, Transfer, PA (US); Robert Beggs, Stoneboro, PA (US); Brent Sedlacek, Elmurst, IL (US); James Anthony Jacobs, New Castle, PA (US)

(73) Assignee: Werner Co., Greenville, PA (US)

( * ) Notice: Subject to any disclaimer, the term of this patent is extended or adjusted under 35 U.S.C. 154(b) by 557 days.

This patent is subject to a terminal disclaimer.

(21) Appl. No.: 15/592,962

(22) Filed: May 11, 2017

(65) Prior Publication Data

US 2018/0179820 A1 Jun. 28, 2018

Related U.S. Application Data

(63) Continuation-in-part of application No. 15/392,085, filed on Dec. 28, 2016.

(51) Int. Cl.

| | |
|---|---|
| ***E06C 7/14*** | (2006.01) |
| ***E06C 1/12*** | (2006.01) |
| ***E06C 7/48*** | (2006.01) |
| ***E06C 7/46*** | (2006.01) |

(52) U.S. Cl.

CPC ..... *E06C 7/14* (2013.01); *E06C 1/12* (2013.01); *E06C 7/46* (2013.01); *E06C 7/48* (2013.01)

(58) Field of Classification Search

CPC ..... E06C 7/14; E06C 7/46; E06C 7/48; E06C 7/143

See application file for complete search history.

(56) References Cited

U.S. PATENT DOCUMENTS

| | | | | | |
|---|---|---|---|---|---|
| 2,138,171 | A * | 11/1938 | Johnson | E06C 7/48 | 182/111 |
| 2,904,128 | A * | 9/1959 | Boham | E06C 7/48 | 150/154 |
| 4,515,242 | A * | 5/1985 | LaChance | E06C 7/14 | 182/106 |
| 4,726,446 | A * | 2/1988 | Perbix | E06C 7/48 | 182/107 |

(Continued)

FOREIGN PATENT DOCUMENTS

| | | | | |
|---|---|---|---|---|
| CA | 2671717 A1 * | 1/2010 | ..... | E06C 1/06 |

*Primary Examiner* — Marcus Menezes

(74) *Attorney, Agent, or Firm* — Ansel M. Schwartz

(57) ABSTRACT

A ladder for a user to climb and which holds a rag includes a first rail having a top and a second rail and rungs attached to the first rail and second rail. The ladder includes an end cap that is attached adjacent to the top of the first rail. The end cap having an attachment portion which attaches to the first rail and a cover portion which covers over the first rail, and extends from the attachment portion. The cover portion having a rag holder. The ladder includes a pad attached to the back of the cover portion which contacts a surface against which the first rail leans against so as not to mar or scratch or damage the surface. An end cap. A method.

14 Claims, 20 Drawing Sheets

(56) References Cited

U.S. PATENT DOCUMENTS 4,771,862 A * 9/1988 Garland ..... E06C 7/48 182/108
4,899,848 A * 2/1990 Parr ..... E06C 7/48 182/108
4,974,699 A 12/1990 Boring
5,259,480 A * 11/1993 Bartnicki ..... E06C 7/14 182/129
5,358,070 A * 10/1994 Bartnicki ..... E06C 7/14 182/129
5,497,848 A * 3/1996 Travis ..... E06C 7/486 182/107
5,533,591 A * 7/1996 Kiska ..... E06C 7/48 182/108
5,913,380 A * 6/1999 Gugel ..... B25H 3/023 182/129
5,950,761 A * 9/1999 Murphy ..... E06C 7/48 182/108
5,988,383 A 11/1999 Armstrong
6,273,289 B1 * 8/2001 Bowman ..... B44D 3/14 220/482
6,499,563 B1 * 12/2002 Bremick ..... E06C 7/42 182/108
6,698,548 B1 3/2004 Verrill
7,108,102 B2 * 9/2006 Woodward ..... E06C 7/48 182/107
7,753,170 B1 * 7/2010 Gibson ..... E06C 7/14 182/107
8,167,088 B2 * 5/2012 Kuhlman ..... E06C 7/003 182/108
2002/0070136 A1 6/2002 Hedges
2002/0104709 A1 * 8/2002 Hines ..... B25H 3/006 182/129
2007/0163837 A1 * 7/2007 Dyer ..... E06C 7/14 182/129
2011/0203873 A1 * 8/2011 Perry ..... E06C 7/14 182/129
2014/0083888 A1 * 3/2014 Constable ..... E06C 7/14 206/372

* cited by examiner

FLY RESTING ON
ENDCAP STOPS

LADDER, END CAP AND METHOD

CROSS-REFERENCE TO RELATED APPLICATIONS

This is a continuation-in-part of U.S. patent application Ser. No. 15/392,085 filed Dec. 28, 2016, incorporated by reference herein.

FIELD OF THE INVENTION

The present invention is related to an end cap that is attached adjacent to a top of a first rail of a ladder which has a rag holder. (As used herein, references to the "present invention" or "invention" relate to exemplary embodiments and not necessarily to every embodiment encompassed by the appended claims.) More specifically, the present invention is related to an end cap of an extension ladder having a rag holder and a stop which limits the movement of the fly section of the extension ladder relative to the base section of the extension ladder.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Whenever a user climbs a ladder, it is extremely common for the user to use one or more objects, such as tools or paintbrushes or paint cans or even rags while standing on the ladder. To make it easier for the user to use these objects, it is advantageous for these objects to have some type of location on the ladder to hold them when the user is not using them at a given moment. By having the objects being held at a convenient location on the ladder, it is not only easier for the user to go back and forth with them while the user is using them, but is also safer for the user to have the objects located in an organized fashion on the ladder so the user does not have to put himself or herself in a precarious position that could result in the user falling off the ladder or dropping the object.

One object that is very commonly used by a user of a ladder is a rag. It would be advantageous and helpful for the user to have a convenient location at the top of the ladder where the user commonly works from the ladder to hold a rag.

BRIEF SUMMARY OF THE INVENTION

The present invention pertains to a ladder for a user to climb and which holds a rag. The ladder comprises a first rail having a top. The ladder comprises a second rail. The ladder comprises rungs attached to the first rail and second rail. The ladder comprises an end cap that is attached adjacent to the top of the first rail. The end cap having an attachment portion which attaches to the first rail and a cover portion which covers over the first rail, and extends from the attachment portion. The cover portion having a front and a back and an interior. The cover portion having a rag holder comprising a first slot and a second slot which define a channel with the interior of the cover portion that extends from the first slot to the second slot, back through the interior and around the back. The rag extends through the channel, from the right side of the interior into the first slot and out the second slot to the left side of the interior to be held by the rag holder. The rag holder of the ladder comprises a pad attached to the back of the cover portion which contacts a surface against which the first rail leans so as not to mar or scratch or damage the surface.

The present invention pertains to an end cap for a top of a first ladder rail for holding a rag. The end cap comprises an attachment portion which attaches to the first rail. The end cap comprises a cover portion which covers over the first rail, and extends from the attachment portion. The cover portion having a front and a back and an interior. The cover portion having a rag holder comprising a first slot and a second slot which define a channel with the interior of the cover portion that extends from the first slot to the second slot, back through the interior and around the back. The rag extends through the channel, from the right side of the interior into the first slot and out the second slot to the left side of the interior to be held by the rag holder. The end cap comprising a pad attached to the back of the cover portion which contacts a surface against which the first rail leans so as not to mar or scratch or damage the surface.

The present invention pertains to a method for using a ladder by a user. The method comprises the steps of climbing up the ladder by the user by stepping on rungs attached to a first rail and a second rail of the ladder. The ladder having an end cap that is attached adjacent to a top of the first rail. The end cap having an attachment portion which attaches to the first rail and a cover portion which covers over the first rail, and extends from the attachment portion. The cover portion having a front and a back and an interior. The cover portion having a rag holder comprising a first slot and a second slot which define a channel with the interior of the cover portion that extends from the first slot to the second slot, back through the interior and around the back. The rag extends through the channel, from the right side of the interior into the first slot and out the second slot to the left side of the interior to be held by the rag holder. There is the step of inserting a rag into the rag holder so the rag extends into the first slot and through the channel and out the second slot and is held by the rag holder.

The present invention pertains to a ladder for a user to climb and which holds a rag. The ladder comprises a base section. The base section comprises a first base rail having a top. The base section comprises a second base rail. The base section comprises base rungs attached to the first base rail and second base rail. The ladder comprises a fly section which engages with the base section so the fly section can move up and down the base section and stays connected to the base section. The fly section comprises a first fly rail having a top. The first fly rail engaged with the first base rail. The fly section comprises a second fly rail engaged with the second base rail. The fly section comprises fly rungs attached to the first fly rail and second fly rail. The ladder comprises an end cap that is attached adjacent to the top of the first fly rail. The end cap having an attachment portion which attaches to the first fly rail and a cover portion which covers over the first fly rail, and extend from the attachment portion. The cover portion has a front and a back and a roof and a bottom and a septum that extends between the front and the back and the roof and the bottom. The cover portion has a right pocket defined by the roof, bottom, front, back and the septum disposed on a right side of the septum. The cover portion has a rag holder comprising a first slot disposed in the front and extending into the right pocket. The cover portion has a stop disposed below the cover portion against which the first base rail contacts when the fly section is in the retracted position. The rag extends into the first slot and through the right pocket to be held by the cover portion. The first slot and the right pocket define a first rag holder. The cover portion has a pad attached to the back of the cover portion which contacts a surface against which the first rail leans so as not to mar or scratch or damage the surface.

The present invention pertains to an end cap for an extension ladder having a base section with a first base rail and a second base rail and a fly section having a first fly rail and a second fly rail. The end cap comprises an attachment portion which attaches to the first fly rail. The end cap comprises a cover portion which covers over the first fly rail, and extends from the attachment portion. The cover portion has a front and a back and a roof and a bottom and a septum that extends between the front and the back and the roof and the bottom. The cover portion has a right pocket defined by the roof, bottom, front, back and the septum disposed on a right side of the septum. The cover portion has a rag holder comprising a first slot disposed in the front and extending into the right pocket. The cover portion has a stop disposed below the cover portion against which the first base rail contacts when the fly section is in the retracted position. The rag extends into the first slot and through the right pocket to be held by the cover portion. The first slot and the right pocket define a first rag holder. The cover portion has a pad attached to the back of the cover portion which contacts a surface against which the first rail leans so as not to mar or scratch or damage the surface.

The present invention pertains to a method for using an extension ladder. The method comprises the steps of moving a fly section of the extension ladder relative to a base section of the extension ladder into an extended position where an overall length of the extension ladder has increased. There is the step of leaning the extension ladder against a surface so an end cap contacts the surface. The end cap comprises an attachment portion which attaches to the first fly rail. The end cap comprises a cover portion which covers over the first fly rail, and extends from the attachment portion. The cover portion has a front and a back and a roof and a bottom and a septum that extends between the front and the back and the roof and the bottom. The cover portion has a right pocket defined by the roof, bottom, front, back and the septum disposed on a right side of the septum. The cover portion has a rag holder comprising a first slot disposed in the front and extending into the right pocket. The cover portion has a stop disposed below the cover portion against which the first base rail contacts when the fly section is in the retracted position. The rag extends into the first slot and through the right pocket to be held by the cover portion. The first slot and the right pocket define a first rag holder. The cover portion has a pad attached to the back of the cover portion which contacts a surface against which the first rail leans so as not to mar or scratch or damage the surface. There is the step of removing the extension ladder from contacting the surface. There is the step of placing the extension ladder in a retracted position. There is the step of leaning the extension ladder against the surface where the first base rail contacts the stop and the fly section is maintained off of the ground.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
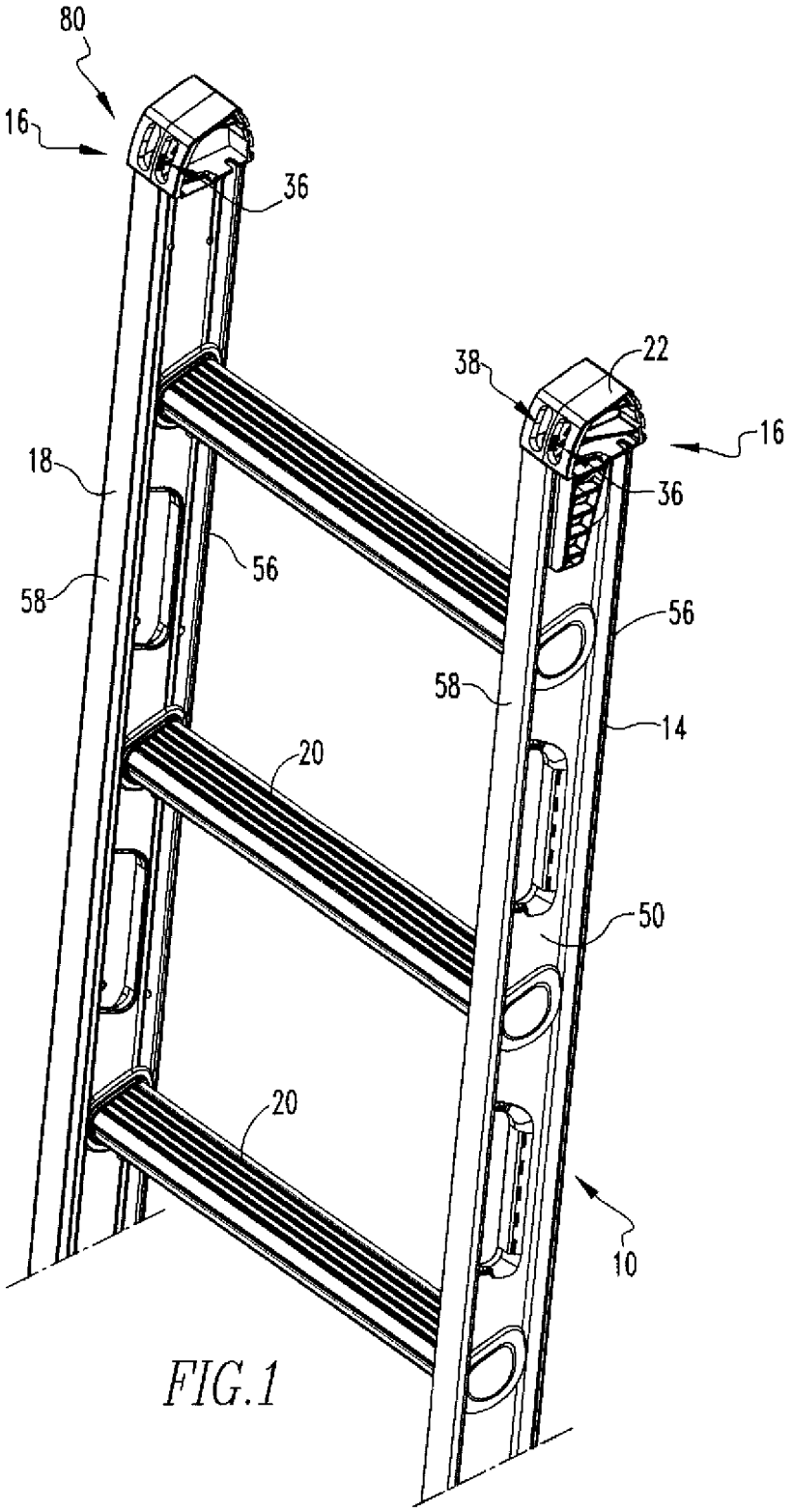
FIG. 1 shows a front perspective view of a front (user) side of a ladder of the present invention.
Figure 2:
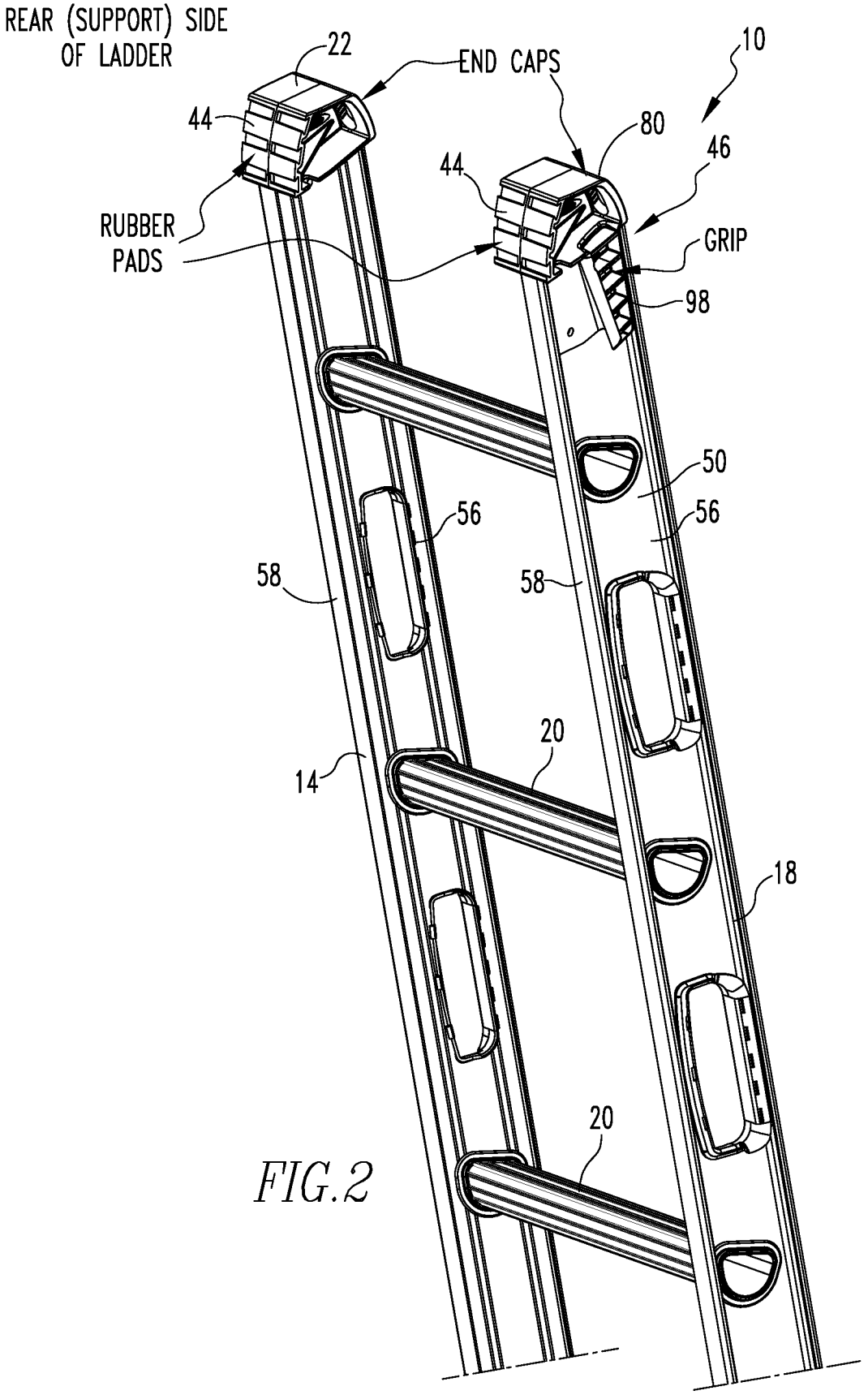
FIG. 2 shows a rear perspective view of the ladder.
Figure 5:
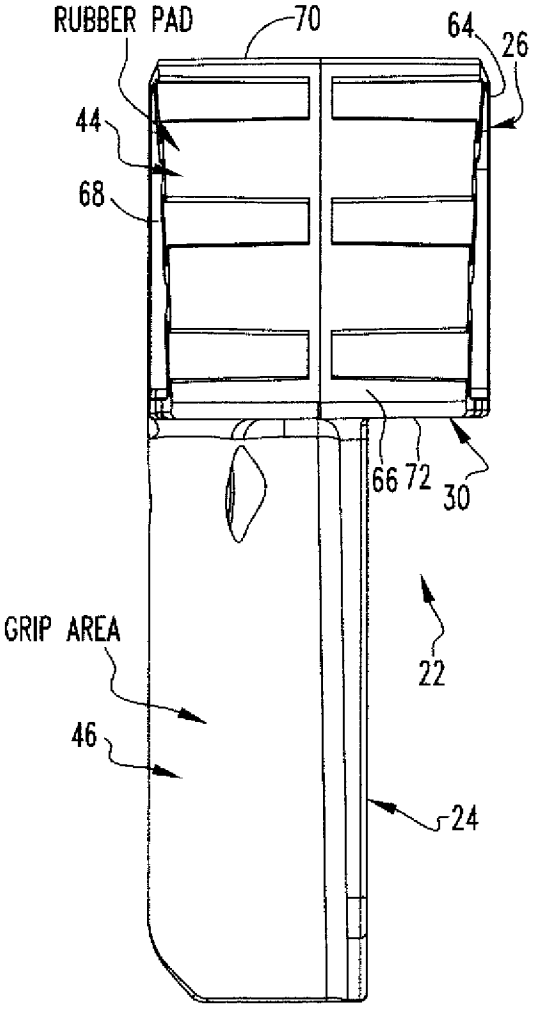
FIG. 5 shows a rear view of the end cap.
Figure 3:
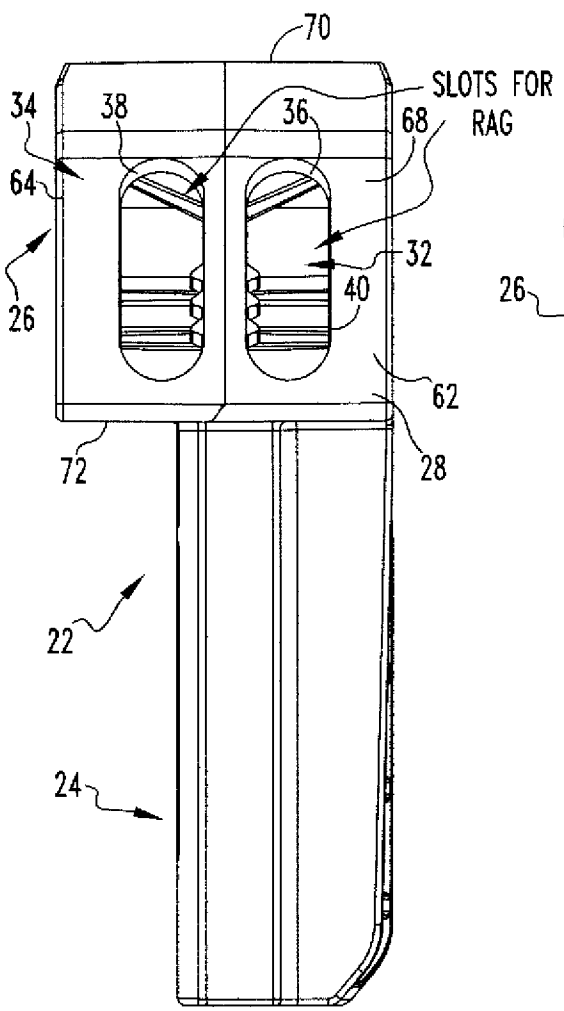
FIG. 3 shows a front view of an end cap.
Figure 7:
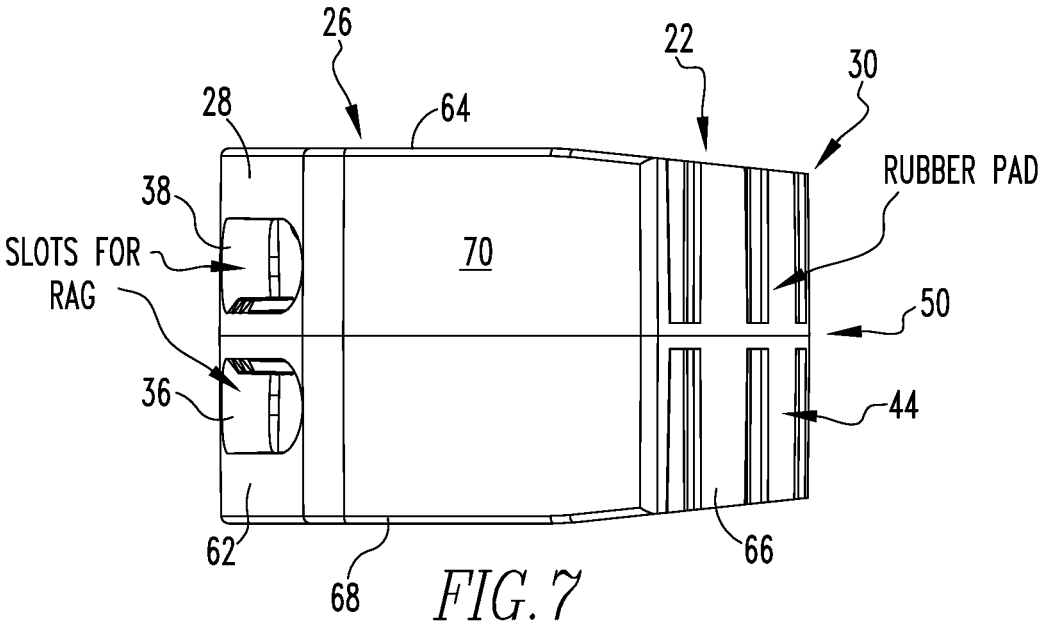
FIG. 7 shows an overhead view of the end cap.
Figure 8:
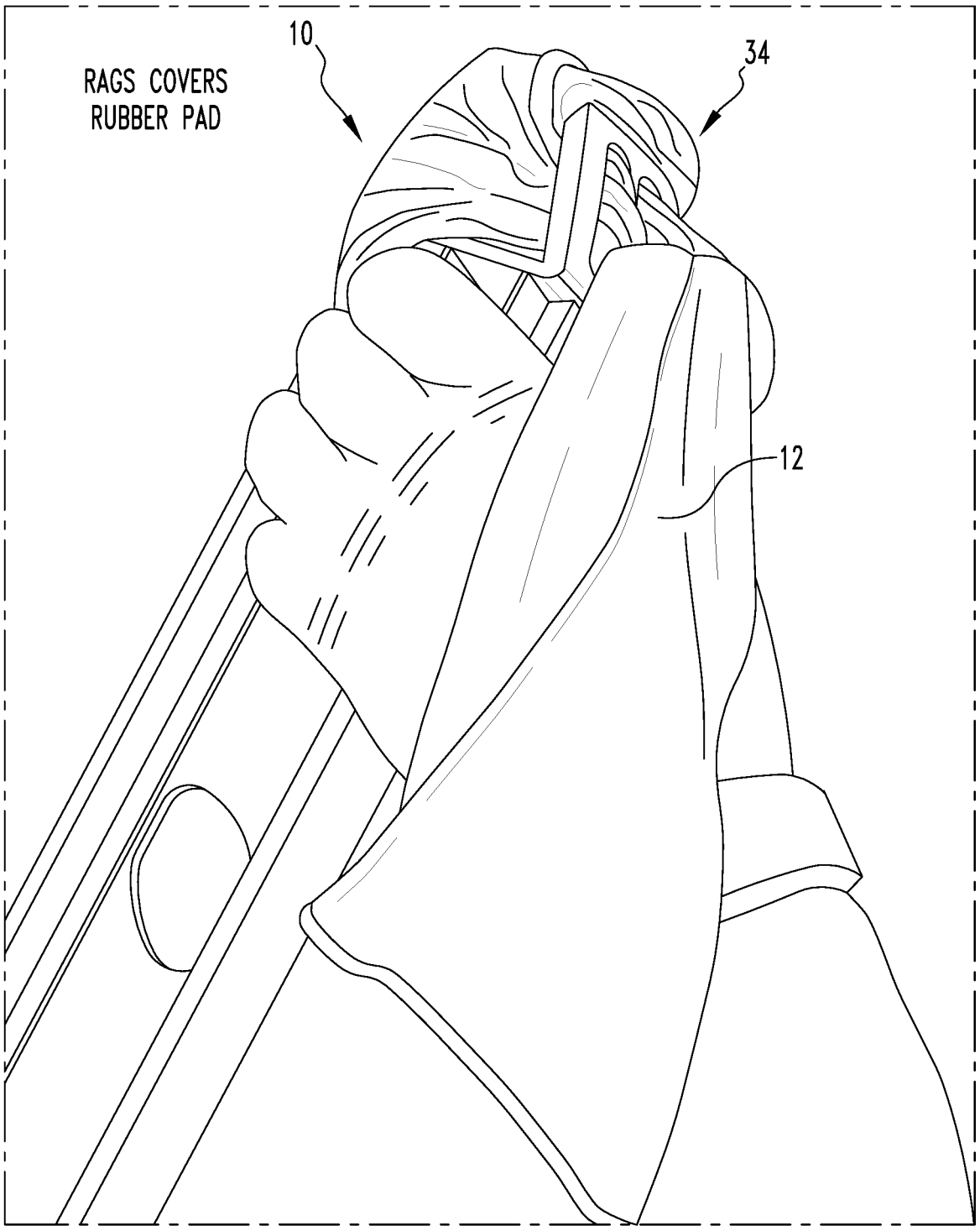
FIG. 8 shows the ladder with a rag in the rag holder.

Referring now to the drawings wherein like reference numerals refer to similar or identical parts throughout the several views, and more specifically to FIGS. 1, 2 and 8 thereof, there is shown a ladder 10 for a user to climb and which holds a rag 12. The ladder 10 comprises a first rail 14 having a top 16. The ladder 10 comprises a second rail 18. The ladder 10 comprises rungs 20 attached to the first rail 14 and second rail 18. The ladder 10 comprises an end cap 22 that is attached adjacent to the top 16 of the first rail 14. The end cap 22 has an attachment portion 24 which attaches to the first rail 14 and a cover portion 26 which covers over the first rail 14, and extends from the attachment portion 24. See FIGS. 3-7. The cover portion 26 has a front 28 and a back 30 and an interior 32, as shown in FIG. 3. The cover portion 26 has a rag holder 34 comprising a first slot 36 and a second slot 38 which define a channel 40 with the interior 32 of the cover portion 26 that extends from the first slot 36 to the second slot 38, back through the interior 32 and around the back 30. The rag 12 extends through the channel 40, from the right side of the interior 32 into the first slot 36 and out the second slot 38 to the left side of the interior 32 to be held by the rag holder 34. The ladder 10 comprises a pad 44 attached to the back 30 of the cover portion 26, as shown in FIG. 5, which contacts a surface against which the first rail 14 leans so as not to mar or scratch or damage the surface. The rag wraps around the pad 44 to further protect the pad 44 and the surface from damage. Alternatively, one end of the rag 12 extends through the fourth side 68 and through the interior 32 on the right side of a dividing wall or septum 46 and through the first slot 36, while the other side of the rag extends around the pad 44 and through the second side 64 and through the interior 32 on the left side of the septum 46 and out through the second slot 38. The ends of the rag 12 can then be tied together to better secure the rag 12 to the end cap 22.

Figure 4:
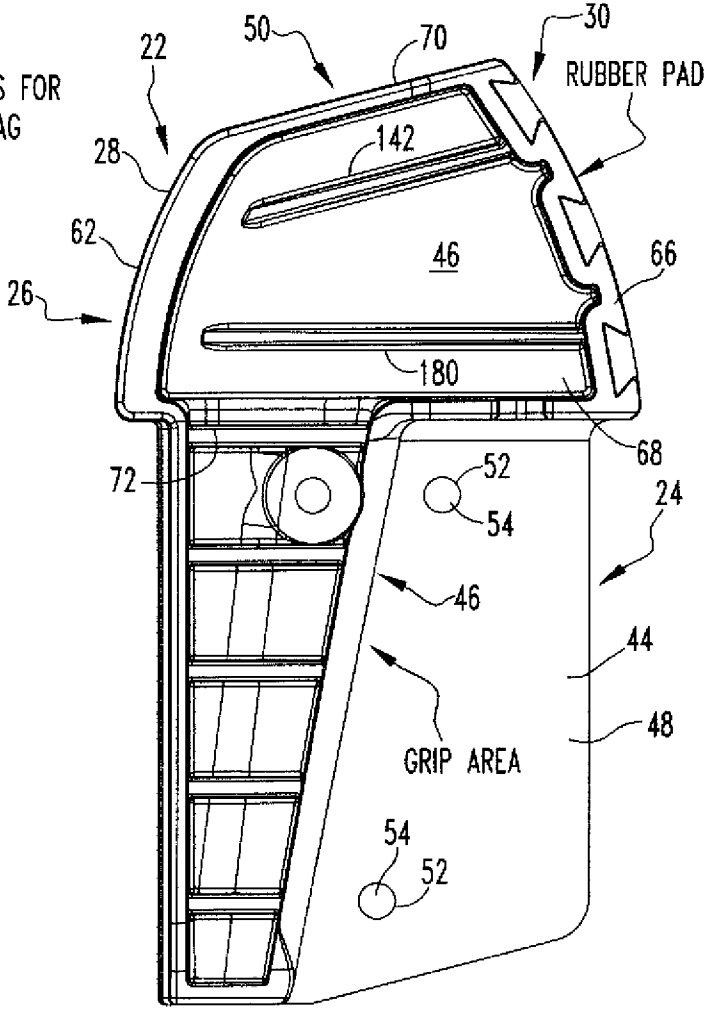
FIG. 4 shows a side view of the end cap.
Figure 6:
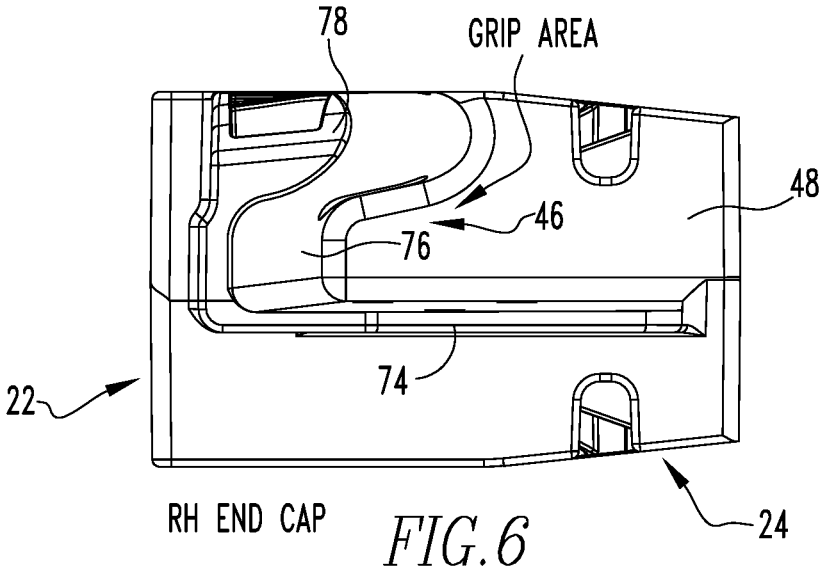
FIG. 6 shows a handle.

The end cap 22 may include a handle 46 which extends from the attachment portion 24, as shown in FIGS. 4-6. The first slot 36 and the second slot 38 of the rag holder 34 may be disposed in the front 28 of the cover portion 26. The attachment portion 24 may include a flat and rectangular plate 48 that conforms to a web 50 of the first rail 14. The plate 48 having a fastener hole 52 through which a fastener 54 extends into the web 50 to attach the end cap 22 to the first rail 14.

The cover portion 26 may cover the web 50 and a first flange 56 that extends from a first side of the web 50 and a second flange 58 that extends from a second side of the web 50 at the top 16 of the first rail 14. The cover portion 26 may form somewhat of an asymmetrical cube 60 with a first side 62 and a second side 64 attached to the first side 62 and the third side 66 attached to the second side 64 and a fourth side 68 attached to the third side 66 and the first side 62, and a top side 70 attached to the first side 62 and second side 64 and third side 66 and fourth side 68, and a bottom side 72 that attaches to the first side 62 and second side 64 and third side 66 and fourth side 68, as shown in FIGS. 4 and 7, and contacts the first flange 56 and second flange 58 and web 50 at the top 16 of the rail. There may be buttressing in the interior 32, the same as or similar to the buttressing described below with the stop 152 embodiment. There may be a stop 152, as described below with the handle 46 and the rag holder 34.

The handle 46 may have a wall 74, a stem 76 attached to the wall 74 and a grip 78 attached to the stem 76 that has a somewhat oval cross-section, as shown in FIG. 6. The wall 74 and the stem 76 and the grip 78 being one continuous solid piece and extending the same distance from the plate 48. The cover portion 26 and the attachment portion 24 may be one continuous piece. There may be handle buttressing 98, such as a series of parallel horizontal plates, as shown in FIG. 2, for supporting the handle. It should be noted on a ladder with no fly and base section (an extension ladder), no stop is necessary. The handle 46 would be used in this case.

The present invention pertains to an end cap 22 for a top 16 of a first ladder rail for holding a rag 12, as shown in FIGS. 3-7. The end cap 22 comprises an attachment portion 24 which attaches to the first rail 14. The end cap 22 comprises a cover portion 26 which covers over the first rail 14, and extends from the attachment portion 24. The cover portion 26 having a front 28 and a back 30 and an interior 32. The cover portion 26 having a rag holder 34 comprising a first slot 36 and a second slot 38 which define a channel 40 with the interior 32 of the cover portion 26 that extends from the first slot 36 to the second slot 38, back through the interior 32 and around the back 30. The rag 12 extending through the channel 40, from the right side of the interior 32, into the first slot 36 and out the second slot 38 to the left side of the interior 32 to be held by the rag holder 34. The end cap 22 comprising a pad 44 attached to the back 30 of the cover portion 26 which contacts a surface against which the first rail 14 leans so as not to mar or scratch or damage the surface. The rag wraps around the pad 44 to further protect the pad 44 and the surface from damage.

The present invention pertains to a method for using a ladder 10 by a user. The method comprises the steps of climbing up the ladder 10 by the user by stepping on rungs 20 attached to a first rail 14 and a second rail 18 of the ladder 10. The ladder 10 having an end cap 22 that is attached adjacent to a top 16 of the first rail 14. The end cap 22 having an attachment portion 24 which attaches to the first rail 14 and a cover portion 26 which covers over the first rail 14, and extends from the attachment portion 24. The cover portion 26 having a front 28 and a back 30 and an interior 32. The cover portion 26 having a rag holder 34 comprising a first slot 36 and a second slot 38 which define a channel 40 with the interior 32 of the cover portion 26 that extends from the first slot 36 to the second slot 38, back through the interior 32 and around the back 30, and a pad 44 attached to the back 30 of the cover portion 26 which contacts a surface against which the first rail 14 leans so as not to mar or scratch or damage the surface. There is the step of inserting a rag 12 into the rag holder 34 so the rag 12 extends through the channel 40, from the right side of the interior 32, into the first slot 36 and out the second slot 38 to the left side of the interior 32 and is held by the rag holder 34. There may be the step of the user grabbing handle 46 that extends from the attachment portion 24.

This invention comprises plastic end caps 22 attached to the extreme upper end of extension ladder 10 fly rails. The end cap 22 is formed with a handle 46 designed to give the user a comfortable place to hold onto while working at the top 16 of the ladder 10. The end cap 22 has a rubber pad 44 on its back 30 which prevents damage to whatever surface the ladder 10 may be resting against. A rag holder 34 formed in the end cap 22 provides the means to easily and securely bind a rag 12 to the end cap 22. The rag 12 provides further protection for the surface supporting the ladder 10, and places the rag 12 in a convenient position to be used by a user such as a painter.

The width and length of the cap corresponds to the width and length of the cross section of the first rail, but slightly larger to cover the first rail. As an example, the width of the cover portion is about 2 inches; the length of the cover portion 3.3 inches; the overall height from the bottom of the attachment portion to the top of the cover portion is about 5.3 inches; with the height of the attachment portion being about 3.4 inches; the height of the cover portion being about 2.1 inches; the width of the attachment portion being about 2 inches; each slot is about 1.2 inches tall and about 0.5 inches wide, with the edge of each slot closest to the side of the attachment portion being about 0.37 inches; and about 0.25 inches between the inner edges of the slots.

Figure 9:
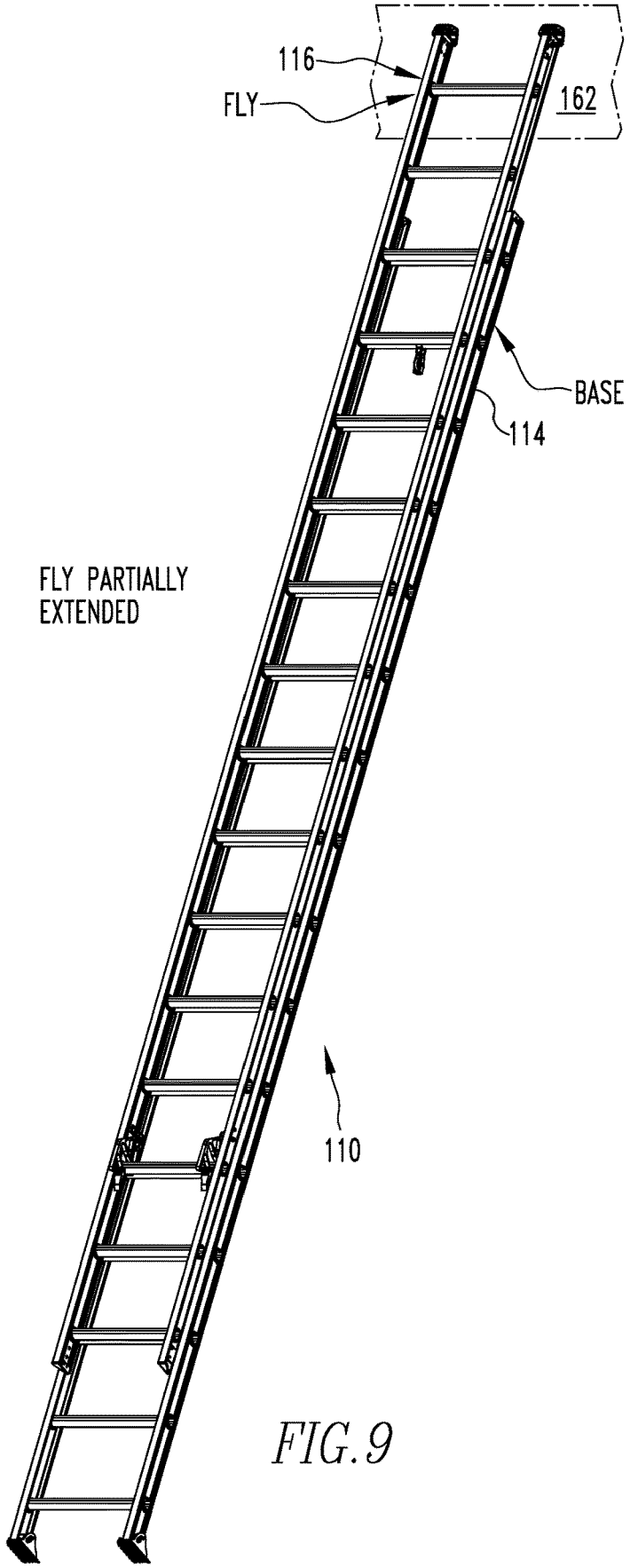
FIG. 9 shows the extension ladder of the present invention with the fly section partially extended.
Figure 10:
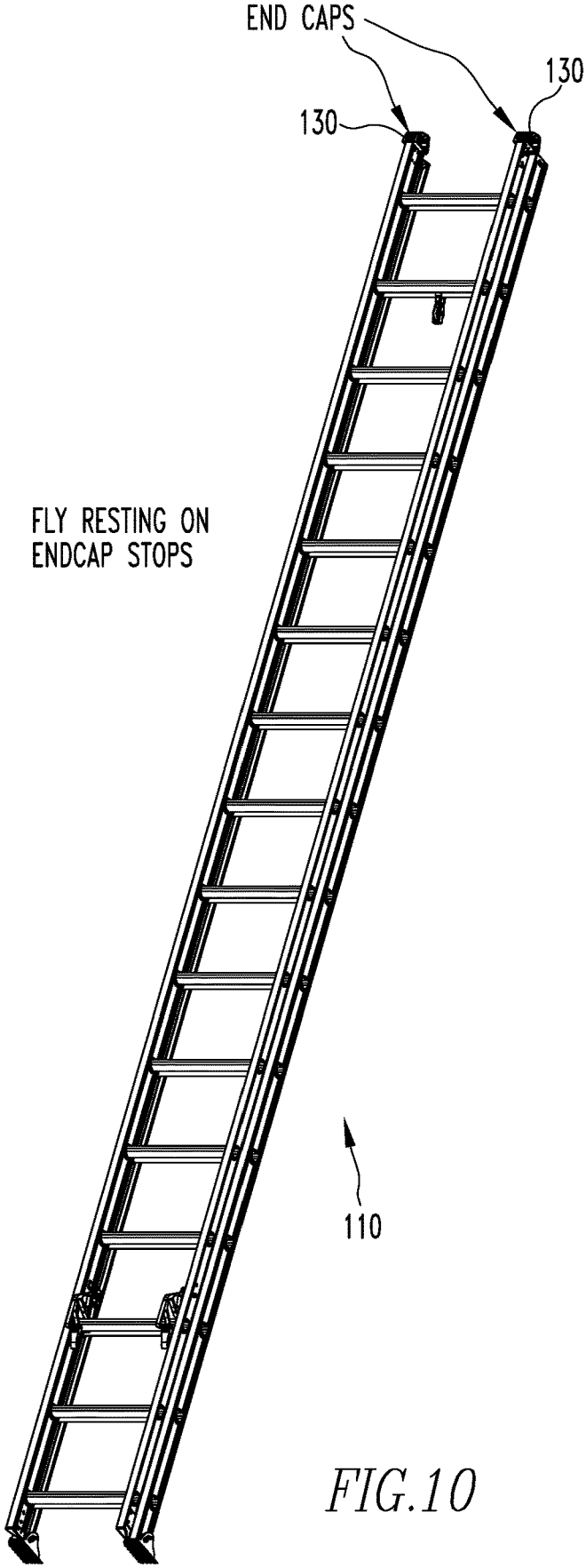
FIG. 10 shows the extension ladder with the fly section resting on end cap stops.
Figure 11:
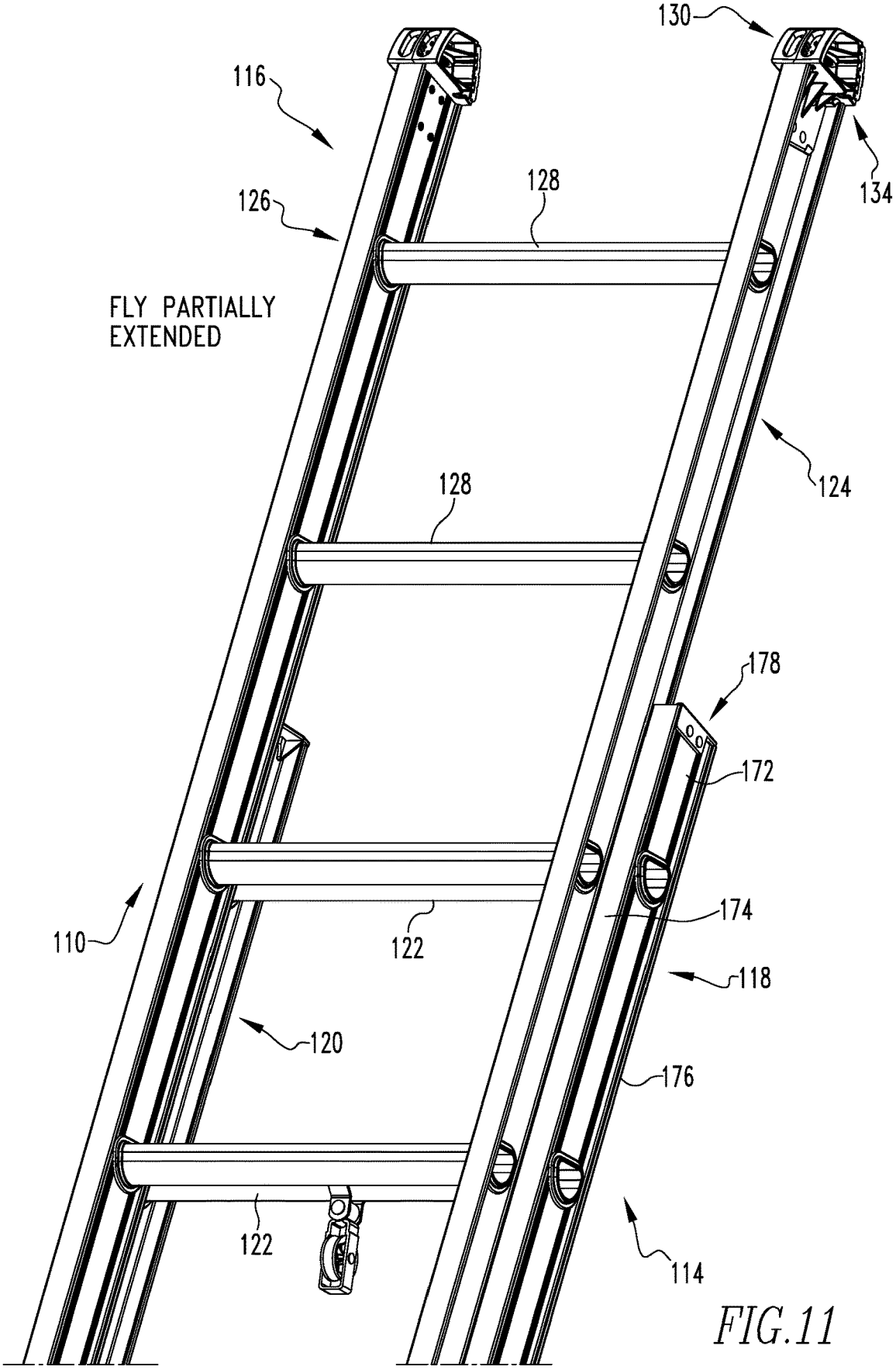
FIG. 11 shows the extension ladder the fly section partially extended.
Figure 12:
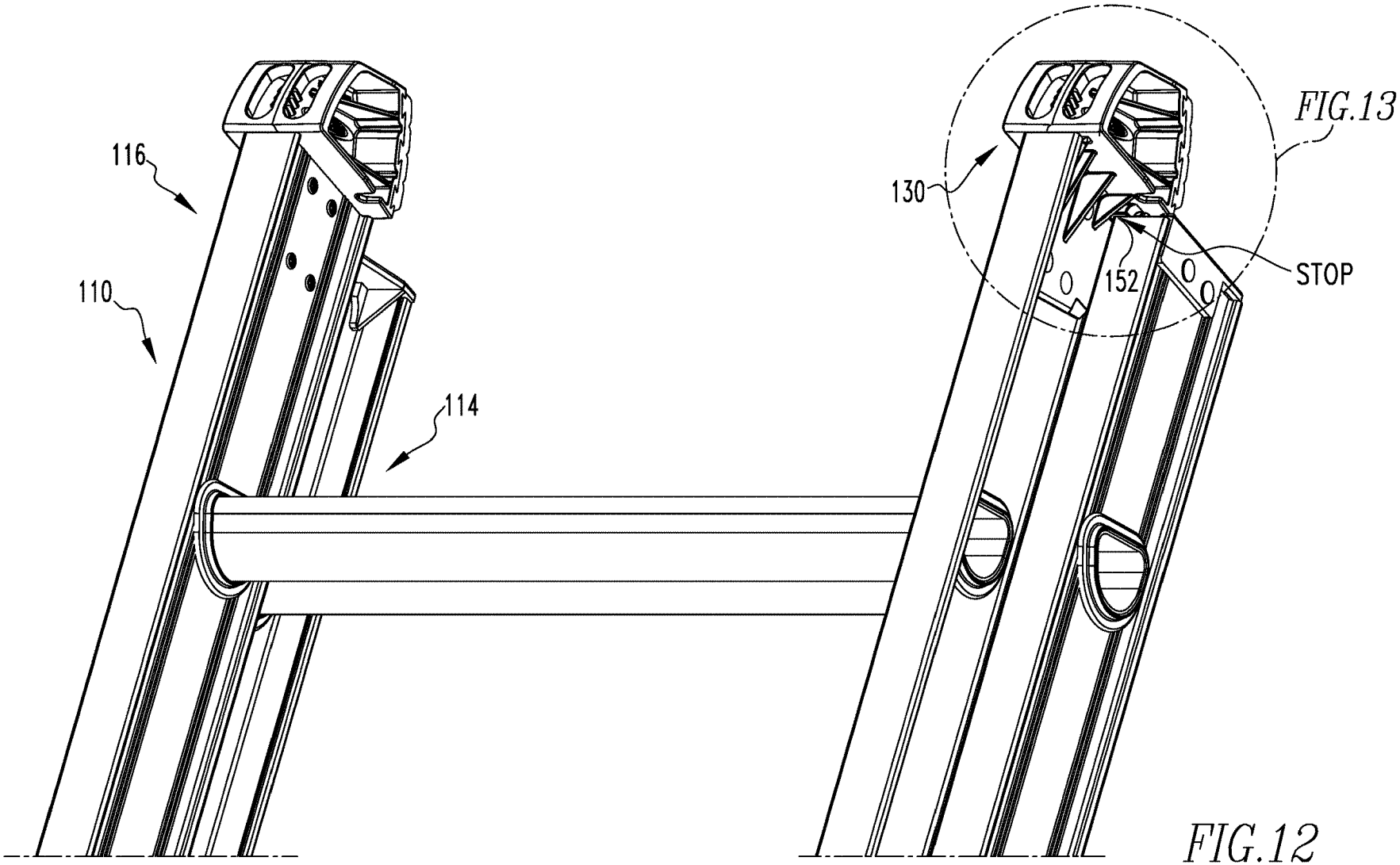
FIG. 12 shows the extension ladder with the fly section resting on an end cap stop.
Figure 13:
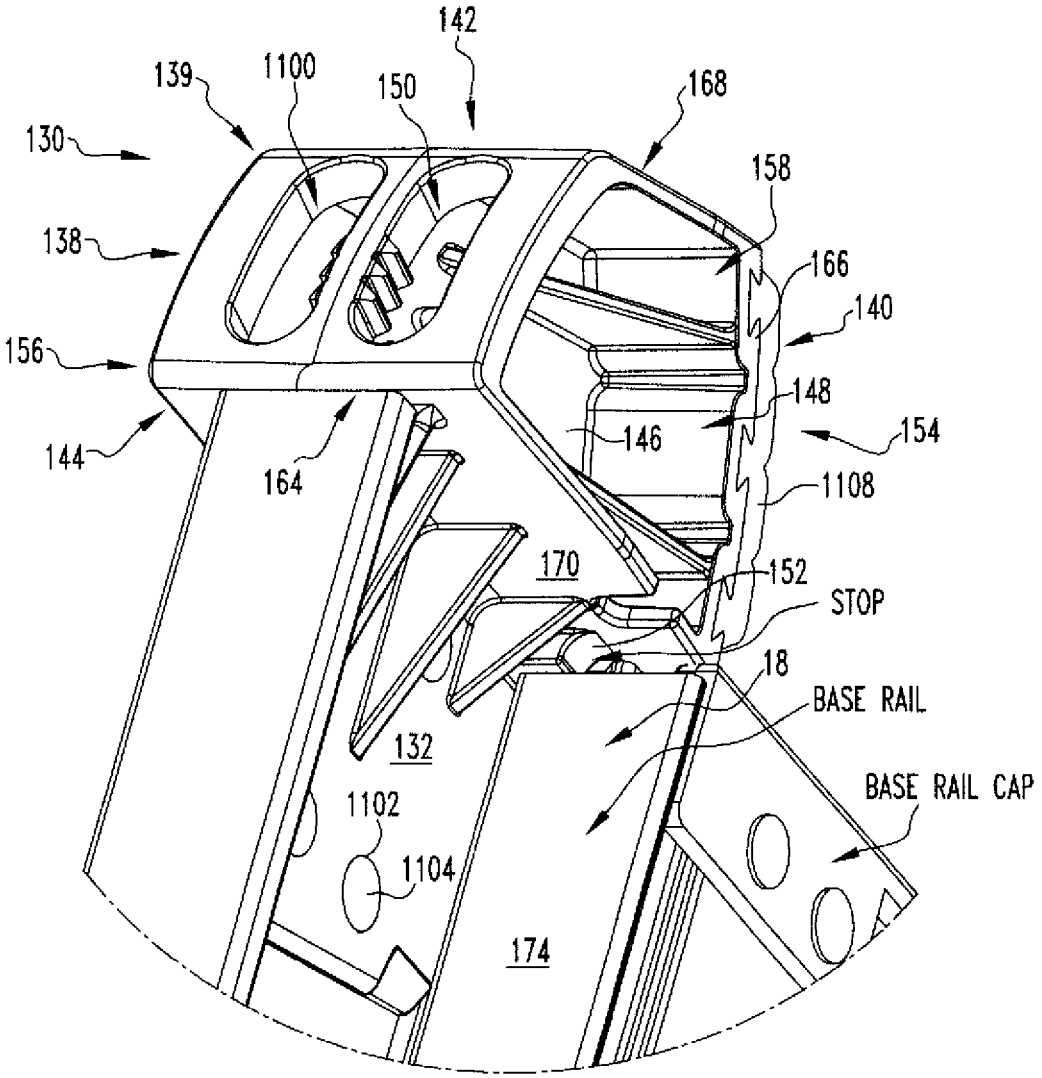
FIG. 13 shows an enlarged view of the fly section resting on a cap end stop.
Figure 14:
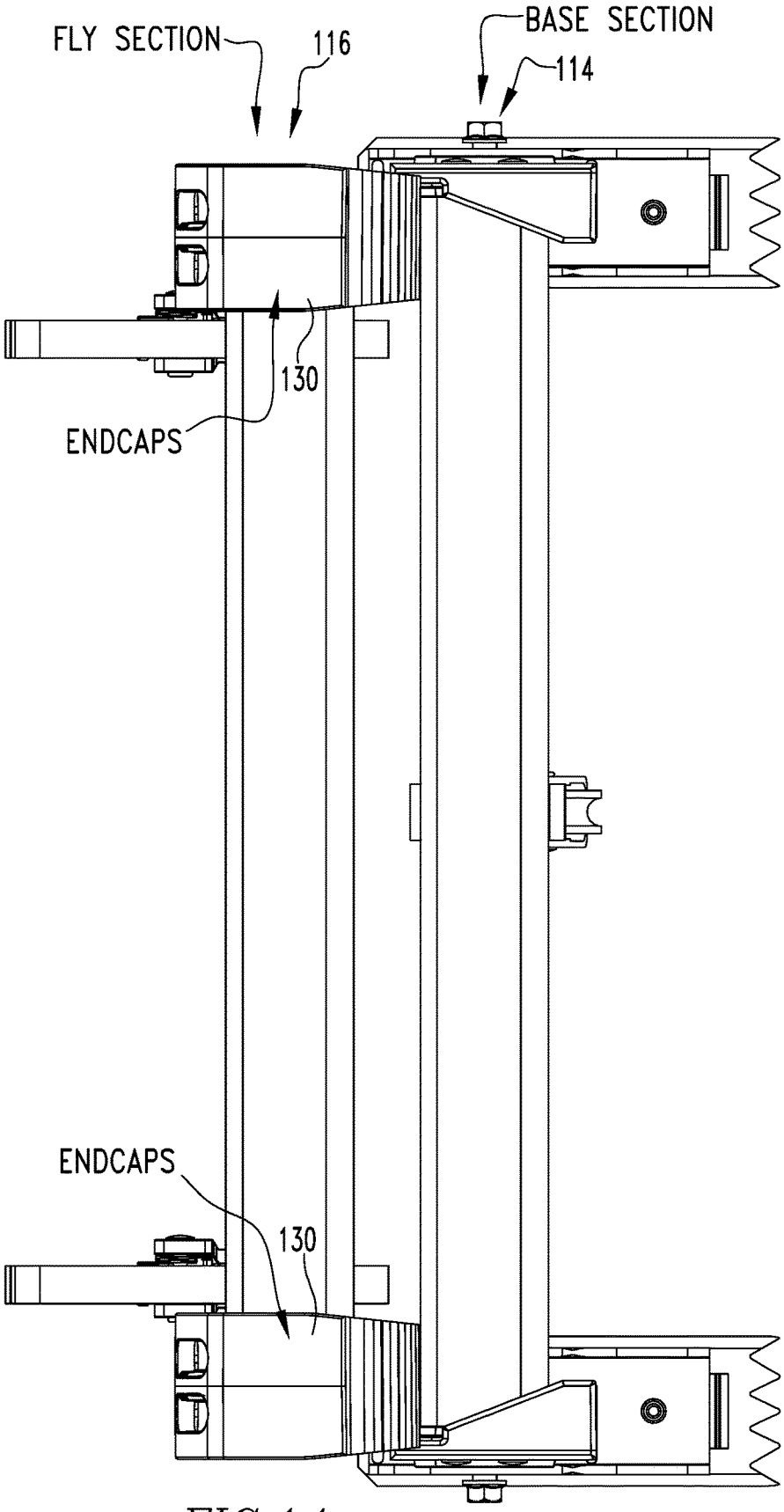
FIG. 14 shows an overhead view of the extension ladder.
Figure 15:
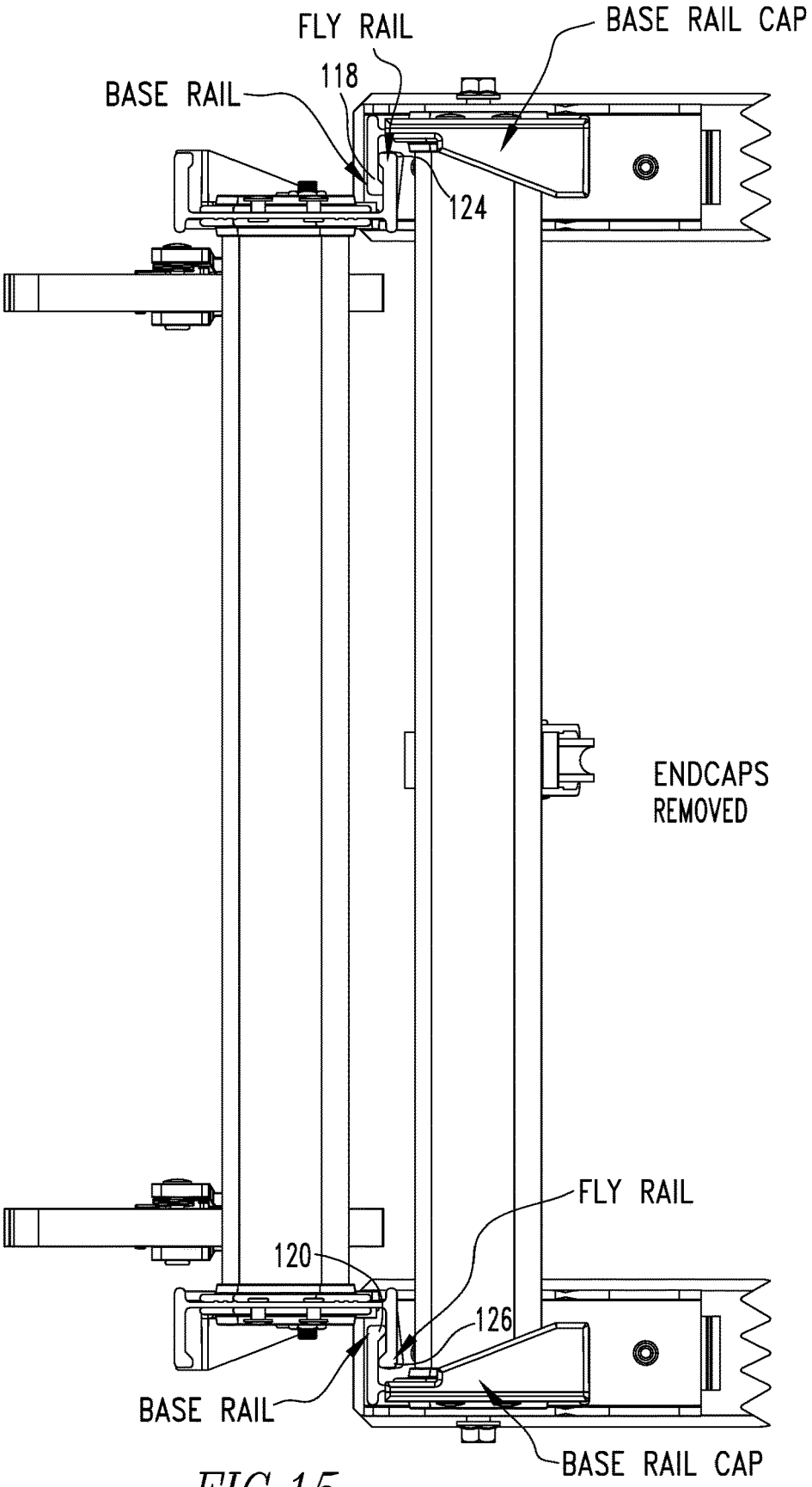
FIG. 15 shows an overhead view of the extension ladder with the end caps removed.
Figure 17:
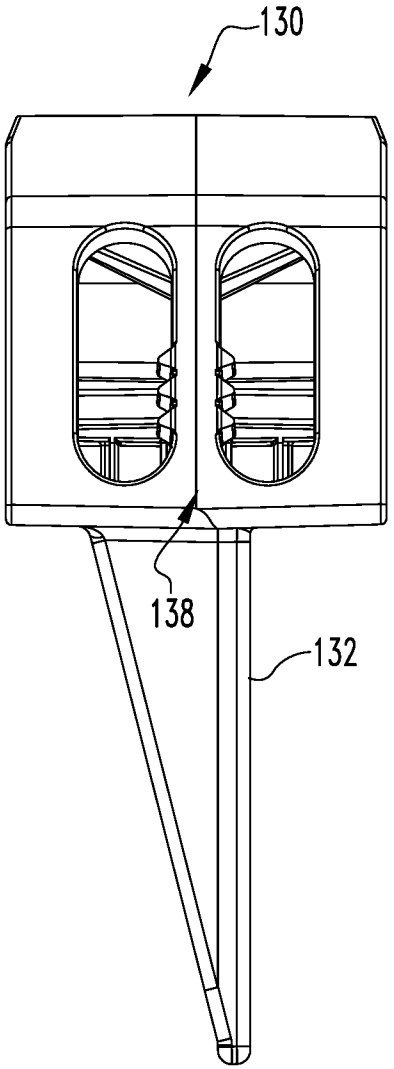
FIGS. 16 through 21 show right, front, bottom, left, overhead and back views, respectively of the end cap.
Figure 16:
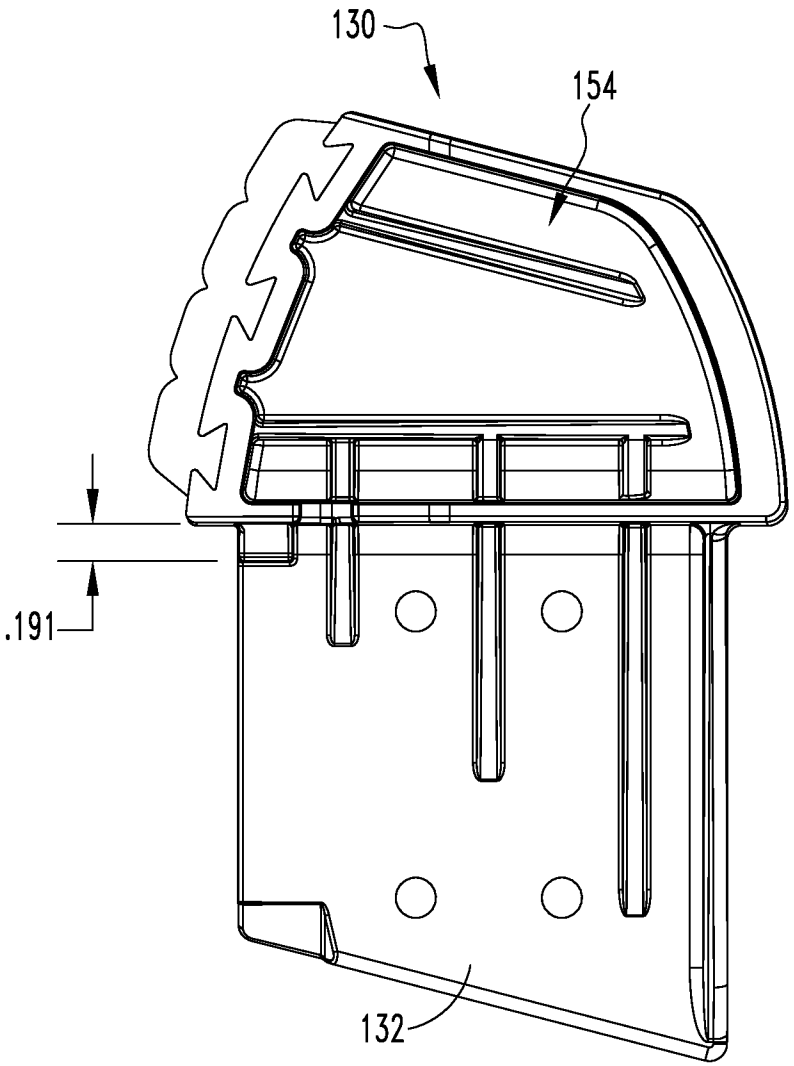
Figure 19:
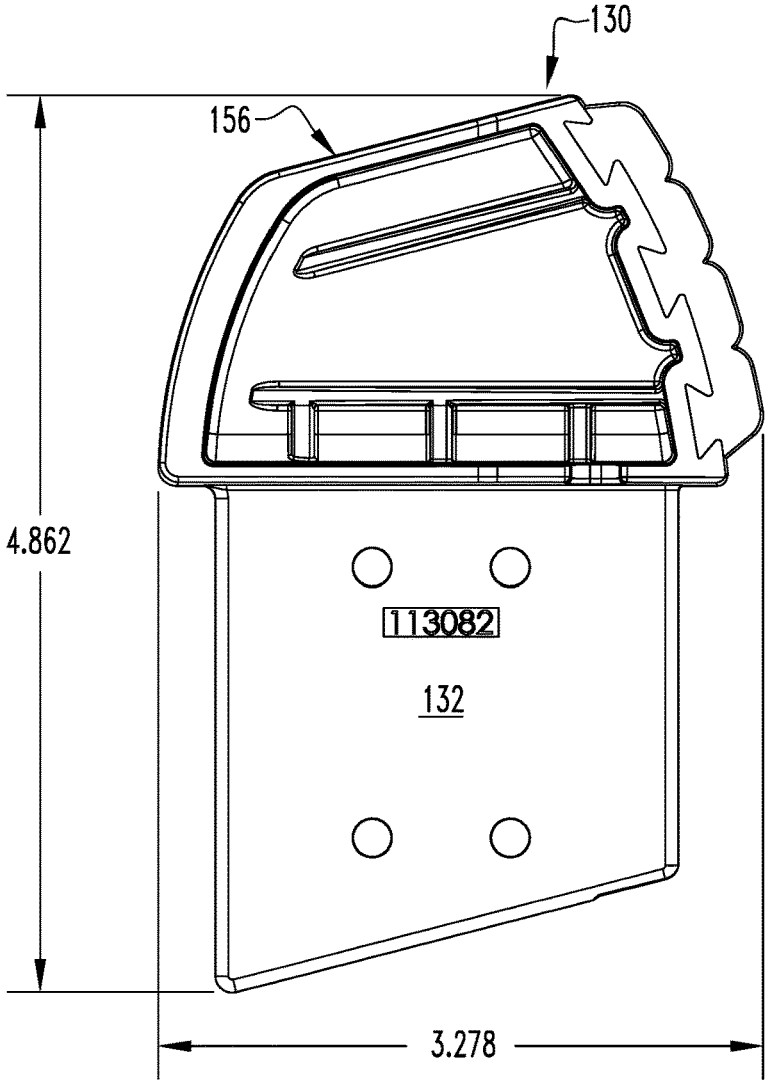
Figure 18:
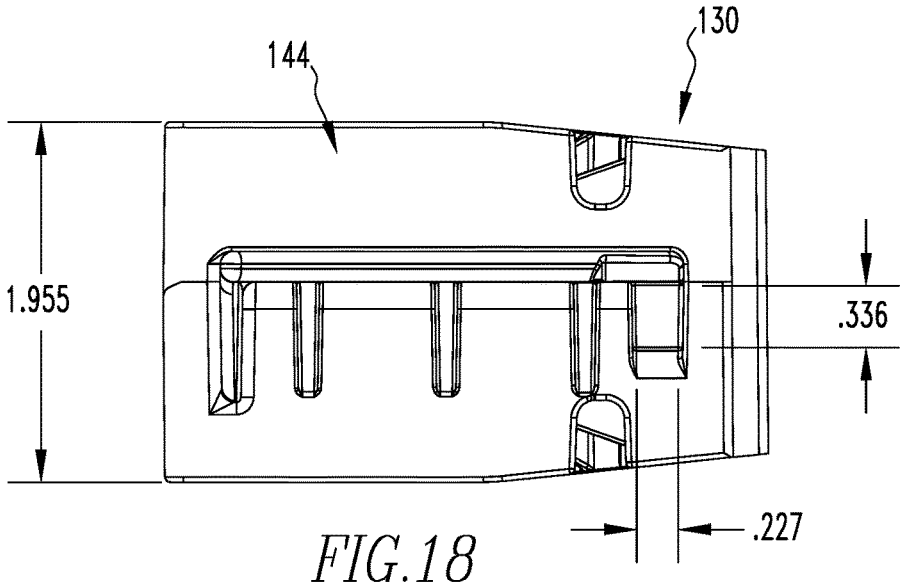
Figure 20:
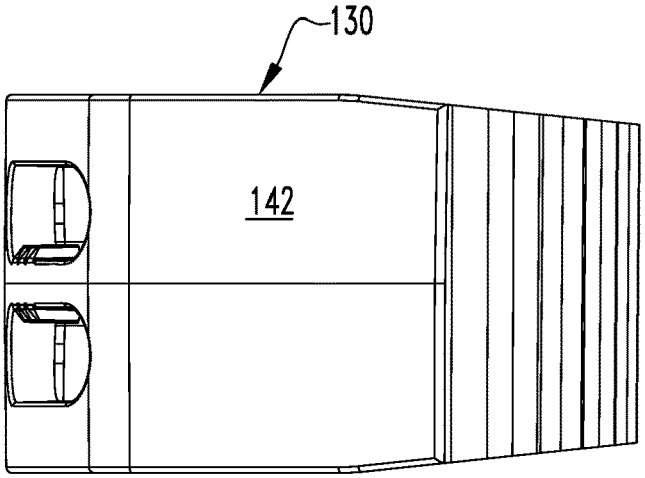
Figure 21:
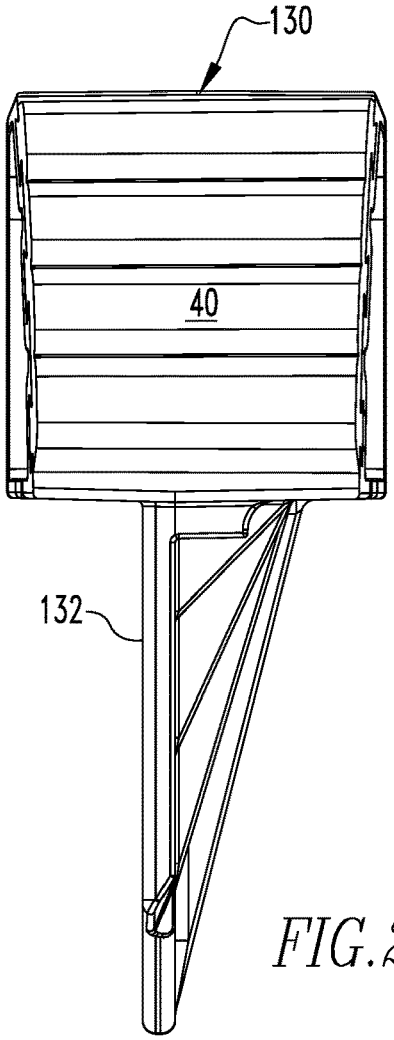
Figure 22:
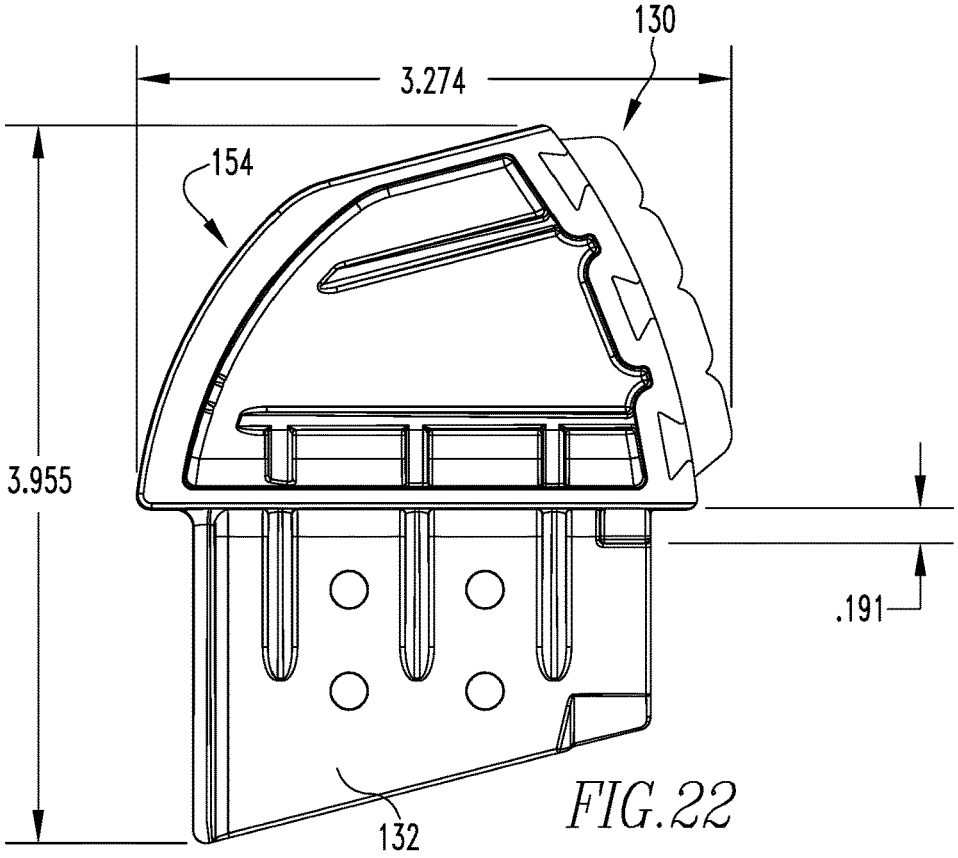
FIGS. 22 through 27 show right, front, bottom, left, overhead and back views, respectively of in alternative embodiment of the end cap.
Figure 23:
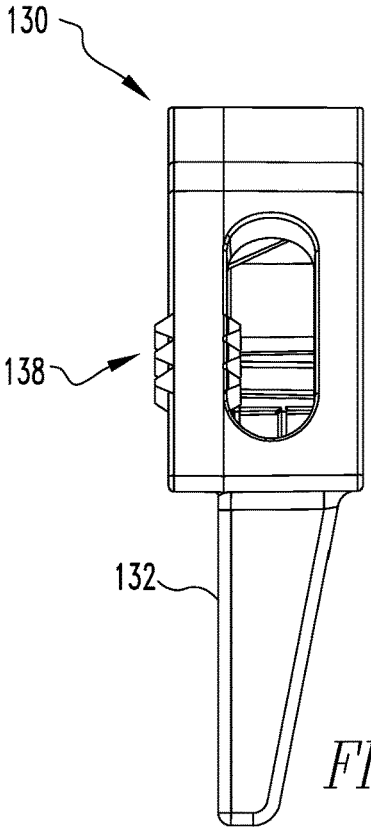
Figure 24:
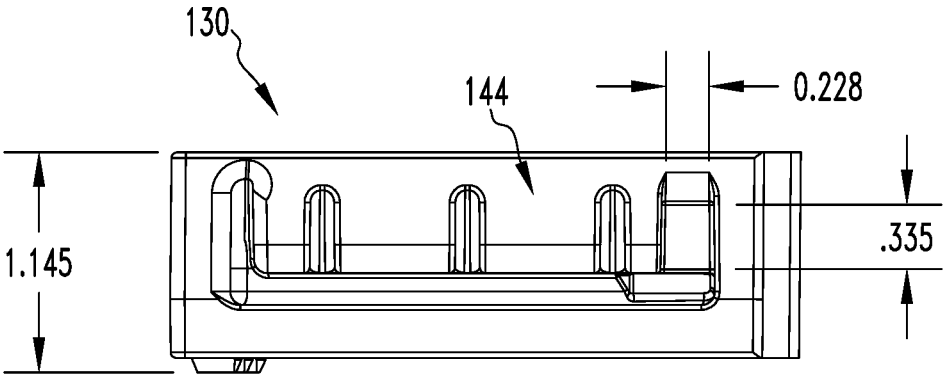
Figure 25:
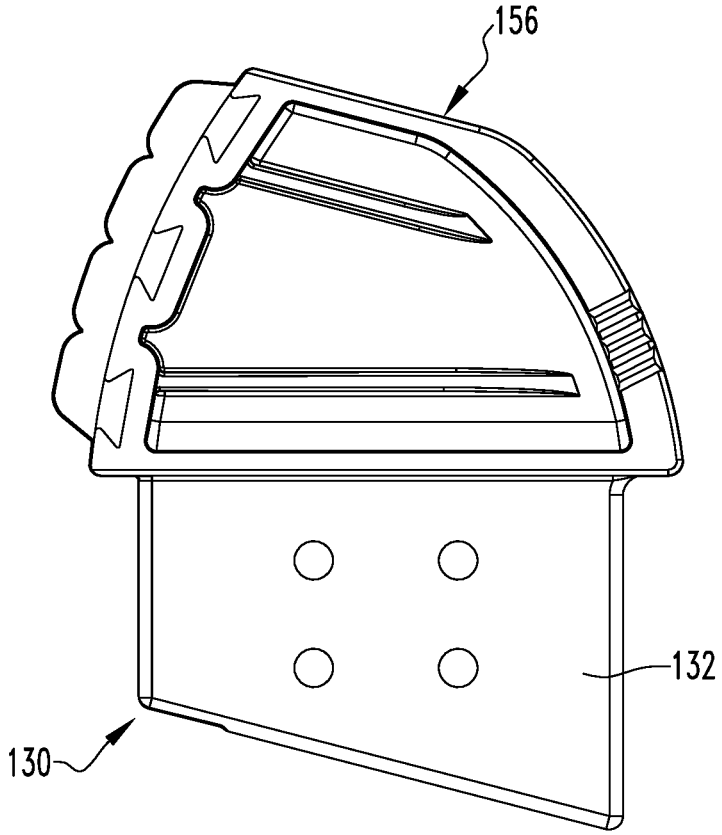
Figure 26:
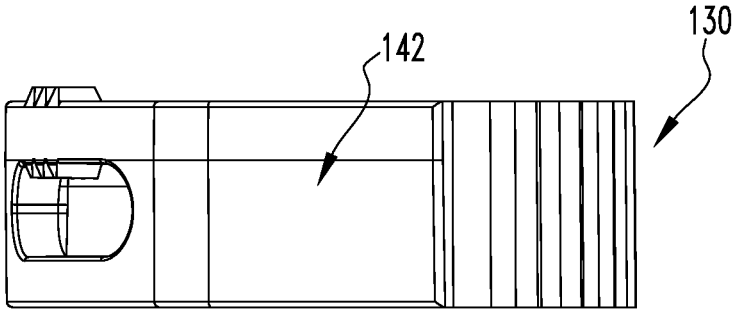
Figure 27:
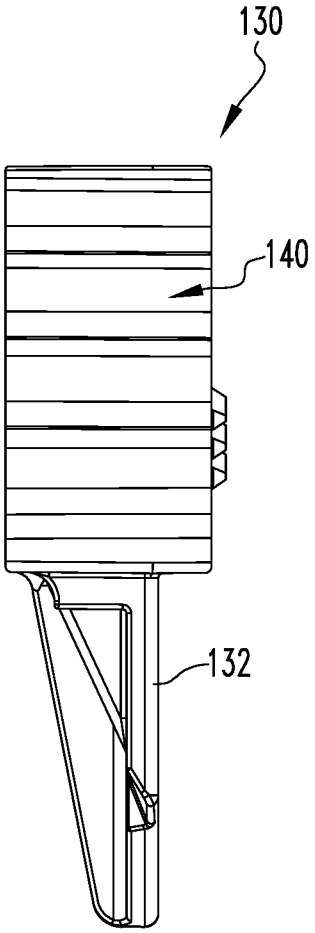

Referring to FIGS. 11, 12 and 13 thereof, there is shown a ladder 110 which holds a rag 112. The ladder 110 comprises a base section 114. The base section 114 comprises a first base rail 118 having a top 178. The base section 114 comprises a second base rail 120. The base section 114 comprises base rungs 122 attached to the first base rail 118 and second base rail 120. The ladder 110 comprises a fly section 116 which engages with the base section 114 so the fly section 116 can move up and down the base section 114 and stays connected to the base section 114 between an extended position, as shown in FIGS. 9 and 11 and a retracted position as shown in FIGS. 10, 12 and 13. FIG. 14 shows an overhead view of the extension ladder 110 with end caps, and FIG. 15 shows an overhead view of the extension ladder 110 without end caps. The fly section 116 and the base section 114 stay engaged together, as required, as is well known in the art.

The fly section 116 comprises a first fly rail 124 having a top 134. The first fly rail 124 engaged with the first base rail 118. The fly section 116 comprises a second fly rail 126 engaged with the second base rail 120. The fly section 116 comprises fly rungs 128 attached to the first fly rail 124 and second fly rail 126. The ladder 110 comprises an end cap 130 that is attached adjacent to the top 134 of the first fly rail 124. The end cap 130 has an attachment portion 132 which attaches to the first fly rail 124 and a cover portion 136 which covers over the first fly rail 124, and extends from the attachment portion 132. The cover portion 136 has a front 138 and a back 140 and a roof 142 and a bottom 144 and a septum 146 that extends between the front 138 and the back 140 and the roof 142 and the bottom 144. The cover portion 136 has a right pocket 158 defined by the roof 142, bottom 144, front 138, back 140 and the septum 146. The right pocket 158 is disposed on a right side 154 of the septum 146. The cover portion 136 has a rag 112 holder 148 comprising a first slot 150 disposed in the front 138 and extending into the right pocket 158. The cover portion 136 has a stop 152 disposed below the cover portion 136 against which the first base rail 118 contacts when the fly section 116 is in the retracted position, as shown in FIGS. 10, 12 and 13. (FIGS. 9 and 11 show the extension ladder 110 in the extended position, where the end cap 130 on the first fly rail 124 is not in contact with the first base rail 118.) The rag 112 extends into the first slot 150 and through the right pocket 158 to be held by the cover portion 136. The first slot 150 and the right pocket 158 define a first rag 112 holder 148. The cover portion 136 has a pad 1108 attached to the back 140 of the cover portion 136 which contacts a surface 162 against which the first rail leans so as not to mar or scratch or damage the surface 162.

Figure 28:
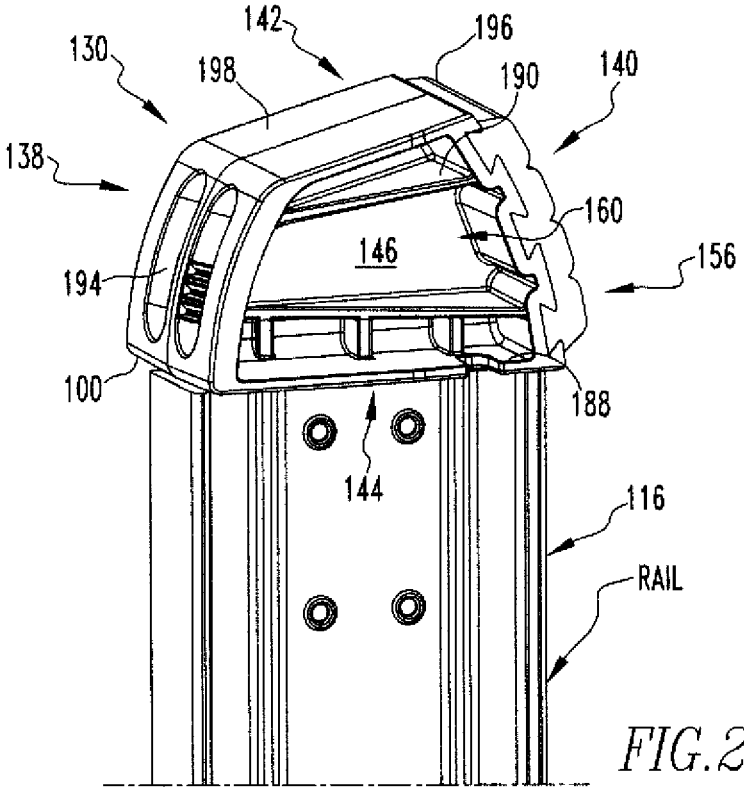
FIG. 28 is a left side view of the end cap attached to the first fly rail.
Figure 29:
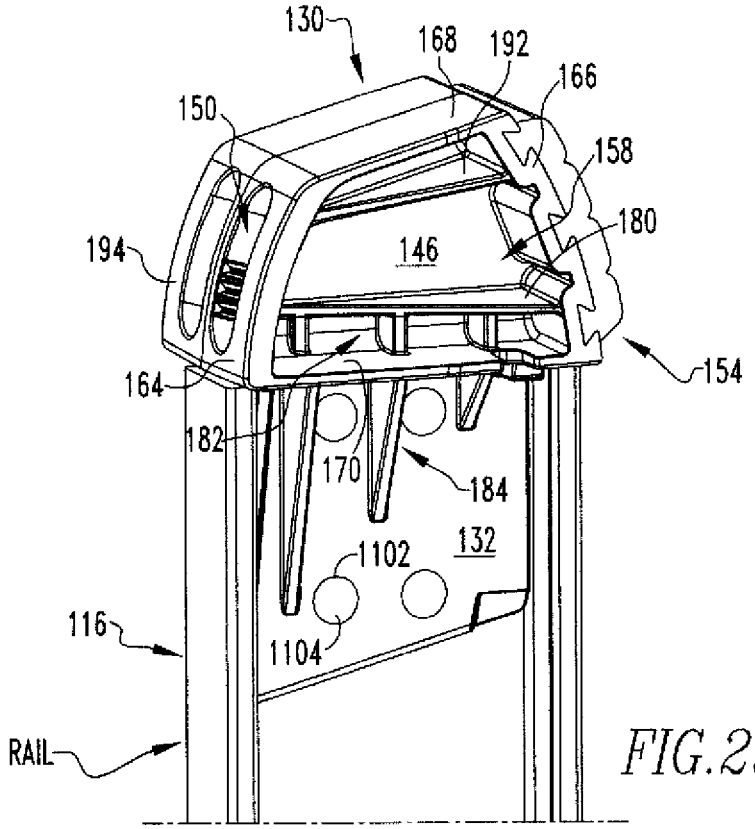
FIG. 29 is a right side view of the end cap attached to the first fly rail.
Figure 30:
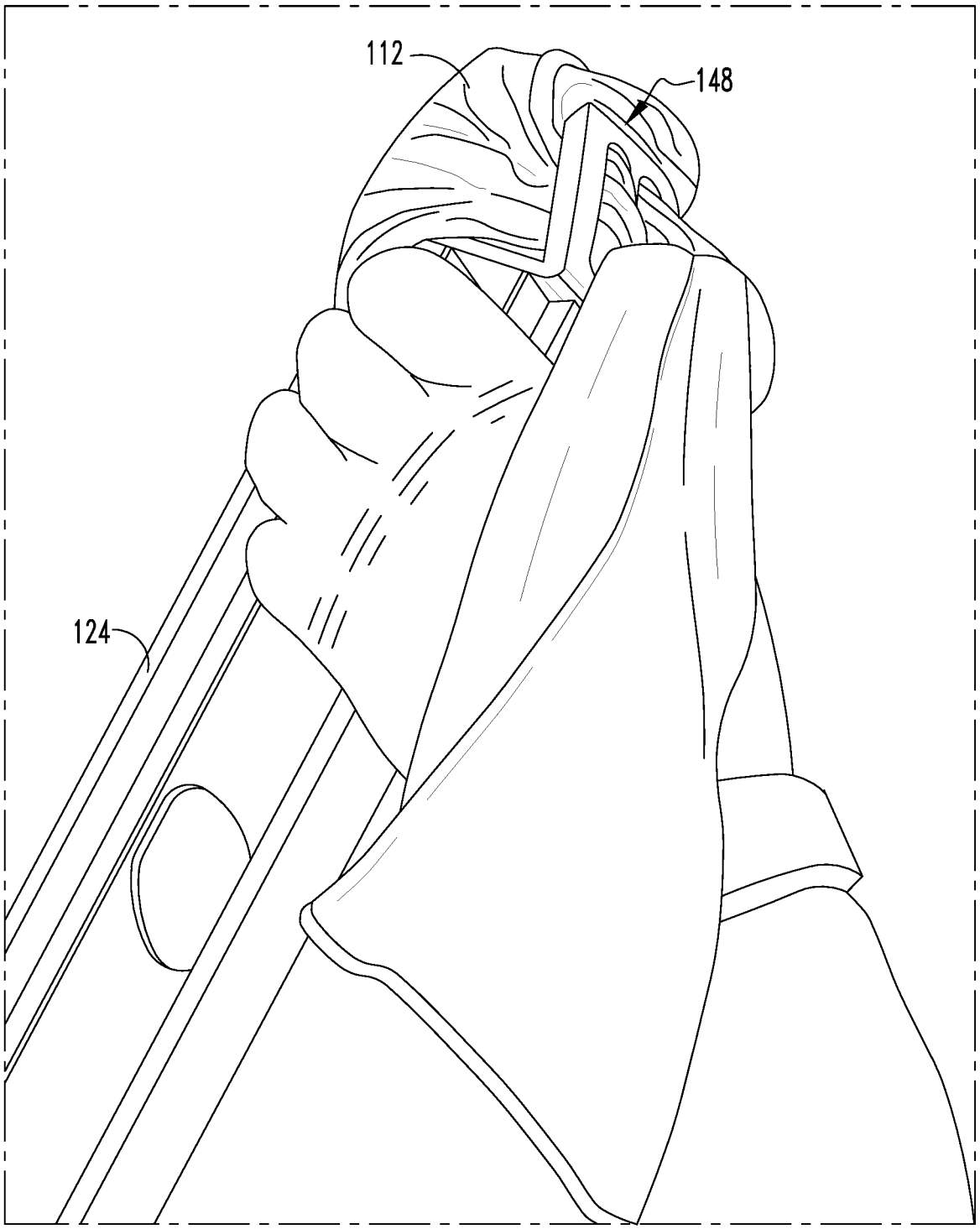
FIG. 30 shows a rag in the rag holder of the end cap on the ladder

FIGS. 16 through 21 show right, front 138, bottom 144, left, overhead and back views, respectively of the end cap 130 with a first slot 150 and the second slot 1100. FIGS. 22 through 27 show right, front, bottom, left, overhead and back views, respectively, of an alternative embodiment of the end cap 130, where there is only a first slot 150. FIG. 28 is a left side view of the end cap 130 attached to the first fly rail 124. FIG. 29 is a right side 154 view of the end cap 130 attached to the first fly rail 124. FIG. 30 shows a rag in the rag holder of the end cap on the ladder.

The front 138 may have a front right portion 164 that extends from the septum 146 to the right, shown in FIGS. 13 and 29. The roof 142 may have a roof right portion 168 that extends from the septum 146 to the right. The back 140 may have a back right portion 166 that extends from the septum 146 to the right. The bottom 144 may have a bottom right portion 170 that extends from the septum 146 to the right. The front right portion 164, back right portion 166, roof right portion 168 and bottom right portion 170 are one continuous piece and define the pocket.

The stop 152 may extend down from the bottom 144 at least 1/10 inch and out from the attachment portion 132 at least 1/8 inch and is at least 1/8 inch wide. The stop 152 does not need to be physically extended from the attachment portion 132, but should extend at least 1/8 inch from the attachment portion 132. The first slot 150 may be in the front portion. The first slot 150 may be at least 2 inches long by 1 inch wide. The first slot 150 may have a rectangular shape with and arc at the top of the first slot 150 and at the bottom 144 of the first slot 150 which connect the two parallel and opposing sides. Alternatively, the first slot 150 can have an oval shape or elliptical shape or combinations thereof. For instance, with an 800 pound impact force applied to the stop 152, in a similar manner to the first fly rail striking the first base rail, the preferred embodiment of the end cap 130, as described herein, exhibits a stress of about 3780 psi, and a deformation of about 0.059 inch, well within the capability of the end cap 130 to withstand. For an 800 pound impact force on the stop 152, the end cap 130 exhibits a stress of less than 7500 psi and a deformation of less than 0.10 inch.

The cover portion 136 may have first buttressing 180 extending between the septum 146 and the back right portion 166 to support the back right portion 166 against forces applied to the back right portion 166, for instance when a load is on the ladder 110 and the pad 1108 presses against the surface 162 due to the load. Here, forces on the pad 1108 are transmitted to the back 140 to the first buttressing 180 to the septum 146. The cover portion 136 may include second buttressing 182 extending from the first buttressing 180 to the bottom right portion 170 to support the bottom right portion 170 against forces applied to the bottom right portion 170, for instance when the fly section 116 moves down and the end cap 130 contacts or strikes the first base rail 118. Here, when the stop 152 strikes or contacts the first base rail 118, the force is transferred through the stop 152 to the bottom 144 to the second buttressing 182 and then to the first buttressing 180. The cover portion 136 may include third buttressing 184 extending from the bottom 144 to the attachment portion 132 to support the cover portion 136 against forces applied to the cover portion 136, for instance when a user is standing on the fly section 116 and puts his hand on the end cap 130 and places his weight on his hand. Here, the downward load on the end cap 130 is transferred to the first fly rail 124 via the bottom 144 through the third buttressing 184 through the attachment portion 132 that is attached to the first fly rail 124.

The first base rail 118 may have a web 172 with an inner flange 174 extending from the web 172 and an outer flange 176 extending from the web 172 and opposing the inner flange 174 with the web 172 between the inner flange 174 in the outer flange 176. The inner flange 174 and the web 172 and the outer flange 176 may form a C-shaped cross-section, as shown in FIG. 15, to better engage with the C-shaped cross-section of the first base rail 118. A top 178 of the inner flange 174 contacts the stop 152 when the first fly rail 124 is in the retracted position, as shown in FIG. 13.

The first buttressing 180, the second buttressing 182 and the third buttressing 184 may be in the shape of a plate. The first buttressing 180 and the third buttressing 184 may be in the shape of a triangular plate, with the triangular plate shape of the first buttressing 180 angling inwards from the back right portion 166 to the septum 146 and the triangular plate shape of the third buttressing 184 angling inwards from the bottom right portion 170 to the attachment portion 132. By having a triangular-shaped, the plate affords clearance, for instance when inserting a rag 112 through the right pocket 158 to the first slot 150. Each of the buttressing may have a plurality of plates, as desired to effectively distribute the loads. Preferably, there are three plates which comprise each buttressing to more effectively support any loads that are applied.

As shown in FIGS. 12 and 28, the front 138 may have a front left portion 192 that extends from the septum 146 to the left. The roof 142 may have a roof left portion 196 that extends from the septum 146 to the left. The back 140 may have a back left portion 194 that extends from the septum 146 to the left, and the bottom 144 may have a bottom left portion 198 that extends from the septum 146 to the left. The front left portion 192, back left portion 194, roof left portion 196 and bottom left portion 198 are one continuous piece and define a left pocket 160 disposed on a left side 156 of the septum 146, with the septum 146 disposed between the right pocket 158 and the left pocket 160. The left pocket 160 may have fourth buttressing 186 that extends between the back left portion 194 and the septum 146 to support the back portion against forces applied to the back 140. The fourth buttressing 186 may be as described above in regard to the first buttressing 180. Furthermore, there may be additional buttressing used, as appropriate to better support loads on the end cap 130. For instance there may be fifth buttressing 188 and six buttressing similar in shape to the first buttressing 180, that extends between back right portion 166 in the septum 146, and the back left portion 194 in the septum 146, respectively, and is positioned in the right pocket 158 and the left pocket 160, respectively, above the first buttressing 180 and the fourth buttressing 186, respectively.

The ladder 110 may include a second slot 1100 disposed in the front left portion 192. The second slot 1100 has the same shape as the first slot 150, and serves as an additional rag holder 148, or for the end of the rag 112 that extends out of the first slot 150 to be inserted into the second slot 1100 and into the second pocket to provide an even more secure rag holder 148 for a rag 112. The attachment portion 132 may be essentially rectangular shaped to conform with a web 172 of the first fly rail 124 and having at least one fastener hole 1102 through which a fastener 1104 extends to attach the attachment portion 132 to the web 172. A second end cap 130, identical to the end cap 130 described above which is attached to the first fly rail 124, can be positioned on the second fly rail 126.

The end caps 130 are preferably made of polypropylene. The thickness of the material used for the end cap 130 is typically 0.125 inch, except for the flat area through which the rivets pass which hold the end cap 130 to the first fly rail 124, where the thickness is about 0.165 inch. The first and second slots for the rag 112 are lozenge-shaped openings about 0.35 to 0.7 inch wide and preferably about 0.480 inch wide, and between about 1 to 2 inches long and preferably about 1.355 inch long. The openings are separated by a distance of between 0.15 to 0.35 inch and preferably about 0.250 inch.

The end cap 130 may include the handle 46, described above, as part of the attachment portion 132. It would be most likely the case that the end cap 130 with the handle 46 would not be an extension ladder, so the step 152 and the second buttressing 180 would not be needed. If the end cap 130 was used with an extension ladder and did have the stop 152, the second buttressing 182 and the handle 46, the handle 46 would be disposed on the attachment portion 132 so the handle 46 would not interfere with the movement of the fly section 116 relative to the base section 114.

The present invention pertains to an end cap 130 for an extension ladder 110 having a base section 114 with a first base rail 118 and a second base rail 120 and a fly section 116 having a first fly rail 124 and a second fly rail 126. The end cap 130 comprises an attachment portion 132 which attaches to the first fly rail 124. The end cap 130 comprises a cover portion 136 which covers over the first fly rail 124, and extends from the attachment portion 132. The cover portion 136 has a front 138 and a back 140 and a roof 142 and a bottom 144 and a septum 146 that extends between the front 138 and the back 140 and the roof 142 and the bottom 144. The cover portion 136 has a right pocket 158 defined by the roof 142, bottom 144, front 138, back 140 and the septum 146 disposed on a right side 154 of the septum 146. The cover portion 136 has a rag holder 148 comprising a first slot 150 disposed in the front 138 and extending into the right pocket 158. The cover portion 136 has a stop 152 disposed below the cover portion 136 against which the first base rail 118 contacts when the fly section 116 is in the retracted position. The rag 112 extends into the first slot 150 and through the right pocket 158 to be held by the cover portion 136. The first slot 150 and the right pocket 158 define a first rag holder 148. The cover portion 136 has a pad 1108 attached to the back of the cover portion 136 which contacts a surface 162 against which the first rail leans so as not to mar or scratch or damage the surface 162.

The present invention pertains to a method for using an extension ladder 110. The method comprises the steps of moving a fly section 116 of the extension ladder 110 relative to a base section 114 of the extension ladder 110 into an extended position where an overall length of the extension ladder 110 has increased. There is the step of leaning the extension ladder 110 against a surface 162 so an end cap 130 contacts the surface 162. The end cap 130 comprises an attachment portion 132 which attaches to the first fly rail 124. The end cap 130 comprises a cover portion 136 which covers over the first fly rail 124, and extends from the attachment portion 132. The cover portion 136 has a front 138 and a back 140 and a roof 142 and a bottom 144 and a septum 146 that extends between the front 138 and the back 140 and the roof 142 and the bottom 144. The cover portion 136 has a right pocket 158 defined by the roof 142, bottom 144, front 138, back 140 and the septum 146 disposed on a right side 154 of the septum 146. The cover portion 136 has a rag holder 148 comprising a first slot 150 disposed in the front 138 and extending into the right pocket 158. The cover portion 136 has a stop 152 disposed below the cover portion 136 against which the first base rail 118 contacts when the fly section 116 is in the retracted position. The rag 112 extends into the first slot 150 and through the right pocket 158 to be held by the cover portion 136. The first slot 150 and the right pocket 158 define a first rag holder 148. The cover portion 136 has a pad 1108 attached to the back of the cover portion 136 which contacts a surface 162 against which the first rail leans so as not to mar or scratch or damage the surface 162. There is the step of removing the extension ladder 110 from contacting the surface 162. There is the step of placing the extension ladder 110 in a retracted position. There is the step of leaning the extension ladder 110 against the surface 162 where the first base rail 118 contacts the stop 152 and the fly section 116 is maintained off of the ground.

The end cap 130 omits the need for bumper covers. The end cap 130 allows the ladder to fully close for transport. The end cap 130 omits the need to duct tape rags to the tip of the rail. The end cap 130 prevents side to side slippage of the ladder 110; it reduces concentration of pressure on a work surface against which the ladder 110 leans; it prevents scratching of the work surface; and it protects fresh paint from being pulled off a wall against which the ladder 110 leans. The end cap 130 is made of non-marring rubber type material. The material is soft and has a long life for routine use on brick/siding. The integrated rag holder allows for easy installation of towels in the provided slots. The rubber pads 1108 of the end cap may be easily replaced upon normal wear.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder for a user to climb and which holds a rag comprising:

a base section comprising:

a first base rail having a top;

a second base rail;

base rungs attached to the first base rail and second base rail;

a fly section which engages with the base section so the fly section can move up and down the base section and stays connected to the base section, the fly section comprising:

a first fly rail having a top, the first fly rail engaged with the first base rail;

a second fly rail having a top, the second fly rail engaged with the second base rail;

fly rungs attached to the first fly rail and second fly rail;

a first end cap that is attached adjacent to the top of the first fly rail, the first end cap having an attachment portion which attaches to a web of the first fly rail with a fastener through a fastener hole of the attachment portion, and a cover portion which covers over the first fly rail, and extends from the attachment portion, the cover portion having a front and a back and a roof and a bottom and a septum that extends between the front and the back and the roof and the bottom, and a right pocket defined by the roof, bottom, front, back and the septum, the right pocket disposed on a right side of the septum, the cover portion having a rag holder comprising a first slot disposed in the front and extending into the right pocket, and a stop disposed below the cover portion against which the first base rail contacts when the fly section is in the retracted position, the rag extending into the first slot and through the right pocket to be held by the cover portion, the first slot and the right pocket defining a first rag holder, and a pad attached to the back of the cover portion which contacts a surface against which the first fly rail leans so as not to mar or scratch or damage the surface, the attachment portion conforms to a shape of the web and fits between flanges of the first fly rail; and a second end cap that is attached adjacent to the top of the second fly rail, the second end cap is separate and apart from the first end cap.

2. The ladder of claim 1 wherein the front has a front right portion that extends from the septum to the right, the roof having a roof right portion that extends from the septum to the right, the back having a back right portion that extends from the septum to the right, and the bottom having a bottom right portion that extends from the septum to the right, the front right portion, back right portion, roof right portion and bottom right portion are one continuous piece and define the pocket.

3. The ladder of claim 2 wherein the stop extends down from the bottom at least ⅛ inch.

4. The ladder of claim 3 wherein the first slot is in the front right portion.

5. The ladder of claim 4 wherein the cover portion has a first buttressing extending between the septum and the back right portion to support the back right portion against forces applied to the back right portion.

6. The ladder of claim 5 wherein the cover portion includes second buttressing extending from the first buttressing to the bottom right portion to support the bottom portion against forces applied to the bottom right portion.

7. The ladder of claim 6 wherein the cover portion includes third buttressing extending from the bottom right portion to the attachment portion to support the cover portion against forces applied to the cover portion.

8. The ladder of claim 7 wherein the first base rail has a web with an inner flange extending from the web and an outer flange extending from the web and opposing the inner flange with the web between the inner flange and the outer flange, the inner flange in the web and the outer flange forming a C shaped cross-section, a top of the inner flange contacts the stop when the first fly rail is in the retracted position.

9. The ladder of claim 8 wherein the first buttressing, the second buttressing and the third buttressing are each in the shape of a plate.

10. The ladder of claim 9 wherein the first buttressing and the third buttressing are in the shape of a triangular plate, with the triangular plate shape of the first buttressing angling inwards from the back portion to the septum in the triangular plate shape of the third buttressing angling inwards from the bottom portion to the attachment portion.

11. The ladder of claim 10 wherein the front has a front left portion that extends from the septum to the left, the roof having a roof left portion that extends from the septum to the left, the back having a back left portion that extends from the septum to the left, and the bottom having a bottom left portion that extends from the septum to the left, the front left portion, back left portion, roof left portion and bottom left portion are one continuous piece and define a left pocket disposed on a left side of the septum, with the septum disposed between the right pocket and the left pocket, the left pocket having fourth buttressing that extends between the back left portion and the septum to support the back portion against forces applied to the back portions.

12. The ladder of claim 11 including a second slot disposed in the front left portion.

13. The ladder of claim 12 wherein the attachment portion is essentially rectangular shaped to conform with a web of the first fly rail and having at least one fastener hole through which a fastener extends to attach the attachment portion to the web.

14. A ladder for a user to climb and which holds a rag comprising:

a base section comprising:

a first base rail having a top;

a second base rail;

base rungs attached to the first base rail and second base rail;

a fly section which engages with the base section so the fly section can move up and down the base section and stays connected to the base section, the fly section comprising:

a first fly rail having a top, the first fly rail engaged with the first base rail;

a second fly rail engaged with the second base rail;

fly rungs attached to the first fly rail and second fly rail; and an end cap that is attached adjacent to the top of the first fly rail, the end cap having an attachment portion which attaches to the first fly rail and a cover portion which covers over the first fly rail, and extends from the attachment portion, the cover portion having a front and a back and a roof and a bottom and a septum that extends between the front and the back and the roof and the bottom, and a right pocket defined by the roof, bottom, front, back and the septum, the right pocket disposed on a right side of the septum, the cover portion having a rag holder comprising a first slot disposed in the front and extending into the right pocket, and a stop disposed below the cover portion against which the first base rail contacts when the fly section is in the retracted position, the rag extending into the first slot and through the right pocket to be held by the cover portion, the first slot and the right pocket defining a first rag holder, and a pad attached to the back of the cover portion which contacts a surface against which the first fly rail leans so as not to mar or scratch or damage the surface, the front has a front right portion that extends from the septum to the right, the roof having a roof right portion that extends from the septum to the right, the back having a back right portion that extends from the septum to the right, and the bottom having a bottom right portion that extends from the septum to the right, the front right portion, back right portion, roof right portion and bottom right portion are one continuous piece and define the pocket, the stop extends down from the bottom at least VS inch, the first slot is in the front right portion, the cover portion has a first buttressing extending between the septum and the back right portion to support the back right portion against forces applied to the back right portion.

* * * * *